US006365308B1

(12) United States Patent
Kojima et al.

(10) Patent No.: US 6,365,308 B1
(45) **Date of Patent: *Apr. 2, 2002**

(54) LIGHT RECEIVING MEMBER FOR ELECTROPHOTOGRAPHY

(75) Inventors: Satoshi Kojima; Keishi Saito, both of Kyoto-fu; Hirokazu Ohtoshi, Nara; Masafumi Sano, Nara; Junichiro Hashizume, Nara; Yasuyoshi Takai, Nara; Ryo Hayashi, Nara; Masahiko Tonogaki, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/967,208

(22) Filed: Oct. 29, 1997

Related U.S. Application Data

(63) Continuation of application No. 08/728,557, filed on Oct. 9, 1996, now abandoned, which is a continuation of application No. 08/170,779, filed on Dec. 21, 1993, now abandoned.

(30) Foreign Application Priority Data

Dec. 21, 1992 (JP) ..... 4-355329
Dec. 21, 1992 (JP) ..... 4-355330

(51) Int. Cl.[7] ..... G03G 5/043; G03G 5/082; G03G 5/147

(52) U.S. Cl. ..... 430/58.1; 430/65; 430/66; 430/67; 430/84

(58) Field of Search ..... 430/65, 66, 67, 430/84, 57, 57.4, 57.7, 58.1, 59.1

(56) References Cited

U.S. PATENT DOCUMENTS

| | | | | | |
|---|---|---|---|---|---|
| 4,225,222 | A | | 9/1980 | Kempter | 355/3 DR |
| 4,265,991 | A | | 5/1981 | Hirai et al. | 430/64 |
| 4,675,265 | A | * | 6/1987 | Kazama et al. | 430/67 |
| 4,794,064 | A | * | 12/1988 | Yamazaki et al. | 430/84 |
| 4,804,604 | A | * | 2/1989 | Shirai et al. | 430/65 |
| 5,190,838 | A | | 3/1993 | Saitoa et al. | 430/65 |

FOREIGN PATENT DOCUMENTS

| | | |
|---|---|---|
| JP | 54-121743 | 9/1979 |
| JP | 57-4053 | 1/1982 |
| JP | 57-111556 | 7/1982 |
| JP | 60-168156 | 8/1985 |
| JP | 60-178457 | 9/1985 |
| JP | 60-225854 | 11/1985 |
| JP | 61-231561 | 10/1986 |
| JP | 62-168161 | 7/1987 |

* cited by examiner

*Primary Examiner*—Janis L. Dote
(74) *Attorney, Agent, or Firm*—Fitzpatrick, Cella, Harper & Scinto

(57) ABSTRACT

In order to maintain excellent electrical, optical and photoconductive characteristics and to significantly improve the durability under adverse environments, a light receiving member for electrophotography according to the present invention comprises in sequence: a supporting member and a light receiving layer; said light receiving layer comprising in sequence at least a photoconductive layer and a surface layer thereon, said photoconductive layer comprising a non-single-crystal material containing silicon atoms as a matrix, and said surface layer comprising an amorphous material containing silicon atoms and carbon atoms as a matrix, wherein the carbon atoms are at least diamond-bonded and graphite-bonded, and wherein from 2% to 30% by number of the carbon atoms are graphite-bonded.

19 Claims, 10 Drawing Sheets

PRIOR ART

LIGHT RECEIVING MEMBER FOR ELECTROPHOTOGRAPHY

This application is a continuation of Application Ser. No. 08/728,557, filed Oct. 9, 1996, now abandoned; which is a continuation of application Ser. No. 08/170,779 filed Dec. 21, 1993, now abandoned.

BACKGROUND OF THE INVENTION

1. Field of the Invention

The present invention relates to a light receiving member for electrophotography which exhibits an improved sensitivity to electromagnetic waves such as light (which herein means in a broad sense light such as ultraviolet rays, visible rays, infrared rays, X-rays and γ-rays.

2. Description of the Prior Art

The photoconductive material used to form a light receiving layer of a light receiving member for electrophotography must have an excellent sensitivity to light, high S/N ratio [photoelectric current (Ip)/dark current (Id)], an absorption spectrum compatible with the spectral characteristics of the irradiating electromagnetic waves, quick responsiveness to light and desirable dark resistivity. Further, the photoconductive material must not be harmful to the human body. This last characteristic is important for a light receiving member that is a component of an electrophotography device to be used in an office.

From the above-mentioned view point, non-single crystal silicon (hereinafter abbreviated as "a-Si") has recently attracted attention as a photoconductive material. For example, Germany Patent Application Laid-Open No. 2746967 and Germany Patent Application Laid-Open No. 2855718 disclose applications in which a-Si is used as a light receiving material for electrophotography.

Further, Japanese Patent Application Laid-Open No. 57-11556 has disclosed a technology for improving the electrical, optical and photoconductive characteristics, such as the dark resistivity value, light sensitivity and the light response, the environmental characteristics at the time of use and stability against aging of a photoconductive member having a photoconductive layer made of an a-Si deposited film. According to this disclosure, a surface charge injection inhibiting layer made of non-photoconductive amorphous material containing silicon atoms and carbon atoms is formed on a photoconductive layer made of amorphous material as a matrix of silicon atoms.

Further, Japanese Patent Application Laid-Open No. 62-168161 has disclosed a technology using amorphous material composed of silicon atoms, carbon atoms and 41 to 70 atomic % hydrogen atoms to serve as a surface layer.

Further, Japanese Patent Application Laid-Open No. 54-121743 has disclosed an image forming member formed by an a-Si photoconductive layer and a supporting member, wherein a depletion layer is formed in the photoconductive layer so that the carrier generation efficiency is improved, the re-combination probability is lowered, and the light response speed and the residual potential are improved. Further, Japanese Patent Application Laid-Open No. 57-4053 has disclosed a very sensitive photosensitive member for electrophotography exhibiting excellent charge retaining performance in which a depletion layer is formed on a lower charge injection inhibiting layer which prevents the injection of carriers that have the same polarity as that of minority carriers.

FIG. 1 is a cross sectional view which schematically illustrates the structure of an example of a conventional light receiving member 200 for electrophotography. Referring to FIG. 1, reference numeral 201 represents a conductive supporting member, and 202 represents a light receiving layer made of a-Si, the light receiving layer 202 having a free surface 203.

A light receiving member for electrophotography of the foregoing type is usually manufactured in such a manner that the conductive supporting member 201 is heated 50° C. to 400° C. and then a film forming process, selected from a group consisting of a vacuum evaporation method, a sputtering method, an ion plating method, a heat CVD method, a light CVD method and a plasma CVD method, is performed making an a-Si photosensitive layer (the light receiving layer) 202. A method has been satisfactorily employed in which raw material gas is decomposed by DC or RF microwave glow discharge as to form an a-Si deposited film on the supporting member.

Conventional light receiving members for electrophotography have been practically used in a-Si copying machine that are not harmful to the human body and have high image quality and excellent durability. However, a necessity for many functions, excellent image quality and satisfactory durability has led to a trend of improving the performance of copying machines. The a-Si copying machine drums must be improved so that the overall cost is reduced. Further, the electrical characteristics and the durability under various environments must also be improved.

Electrical, optical and light conductive characteristics, such as the dark resistivity, light sensitivity and light response, environmental characteristics at the time of use, aging resistance and durability of conventional photosensitive material for electrophotography having the photoconductive layer formed with a-Si material must be further improved. For example, recent demands that electrophotography apparatus have higher processing speeds and form higher quality images have necessitated that the electrical characteristics and the light conductive characteristics of the photosensitive member for electrophotography be improved.

Specifically, in the case where a-Si is employed to form a photosensitive member for electrophotography there arise problems concerning optical memory, charging characteristics, residual potential, sensitivity and clear half tone which do not arise in the conventional low-speed charging-exposing-developing process. When using the conventional process, it has been shown that any improvement in the charging performance will deteriorate the residual potential and the optical memory. Therefore, the foregoing factors cannot be satisfied simultaneously while maintaining the respective desired levels. Moreover, employment of a-Si in a high speed process causes a problem of nonuniformity of half tone, that is, excessive roughness. In a case where a-Si material is used in a full color electrophotography apparatus, the optical memory and prevention of the half tone roughness can be further improved in order to improve the gradation expression and color reproducibility.

The conventional a-Si drum sometimes encounters a problem of an unsatisfactory copy density level if it is continuously used in an excessively high organic solvent concentration environment. Another problem sometimes arises in that a shadow-like defective image is formed. The foregoing problems must be improved to obtain stable images regardless of the environment.

Accordingly, the characteristics of the a-Si material, the structure of the layers, the chemical composition of each layer and forming methods have been improved at the time of designing the light receiving member for electrophotography.

SUMMARY OF THE INVENTION

An object of the present invention is to provide a light receiving member for electrophotography capable of overcoming problems experienced with the conventional light receiving member for electrophotography made of a-Si.

Another object of the present invention is to provide a light receiving member for electrophotography which has a light receiving layer comprising a non-single-crystal material which is composed of silicon atoms as a matrix, which exhibits electrical, optical and photoconductive characteristics that are always stable regardless of the environment for use, excellent light fatigue resistance, excellent durability such that it does not deteriorate even if it is repeatedly used, humidity resistance and in which the residual potential can substantially be eliminated. Another object of the present invention is to provide an excellent light receiving member for electrophotography capable of always forming stable images even under an adverse environment.

Another object of the present invention is to provide a light receiving member for electrophotography which exhibits excellent electrical characteristics in which no charging performance, residual potential, sensitivity and optical memory problems arise even if it is adapted to a high speed process electrophotographic apparatus, with which a clear images free from rough half tone image can be formed, which enables a high resolving power and high quality image to be obtained easily and to which a conventional electrophotographic method can effectively be adapted.

Another object of the present invention is to provide a SIMS interface evaluation system capable of accurately evaluating the interface steepness of a multi-layer film as compared with a conventional system.

According to one aspect of the present invention, there is provided a light receiving member for electrophotography comprising in sequence: a supporting member and a light receiving layer; said light receiving layer comprising in sequence at least a photoconductive layer and a surface layer thereon, said photoconductive layer comprising a non-single-crystal material containing silicon atoms as a matrix, and said surface layer comprising an amorphous material containing silicon atoms and carbon atoms as a matrix, wherein the carbon atoms are at least diamond-bonded and graphite-bonded, and wherein from 2% to 30% by number of the carbon atoms are graphite-bonded.

According to another aspect of the present invention, there is provided a light receiving member for electrophotography comprising: an electrically conductive supporting member; a photoconductive layer; and a charge injection inhibiting layer between said electrically conductive supporting member and said photoconductive layer and having a function of inhibiting injection of carriers from said supporting member side into said photoconductive layer, wherein said photoconductive layer and said charge injection inhibiting layer are each a non-single-crystal material mainly composed of silicon and containing hydrogen, said photoconductive layer has a reduced polarity p-type conduction when said light receiving member for electrophotography is positively charged and has a reduced polarity n-type conduction when said light receiving member for electrophotography is negatively charged, said charge injection inhibiting layer has a reduced polarity p-type conduction when said light receiving member for electrophotography is positively charged and has a reduced polarity n-type conduction when said light receiving member for electrophotography is negatively charged, and said charge injection inhibiting layer has a density of states from $1\times10^{17}$ $cm^{-3}$ to $5\times10^{19}$ $cm^{-3}$.

According to another aspect of the present invention, there is provided an interface evaluation system of a type measuring the interface steepness of stacked films by a secondary ion mass spectrometry, said interface evaluation system comprising: a unit for calculating the scatter, which is the reference of the interface steepness, from a result of a secondary ion mass spectrometry of a subject element in the direction of the thickness; and a calculating unit for displaying said scatter with respect to the subject parameter of the secondary ion mass spectrometry.

Other and further objects, features and advantages of the invention will be appear more fully from the following description.

DETAILED DESCRIPTION OF THE INVENTION

Figure 1:
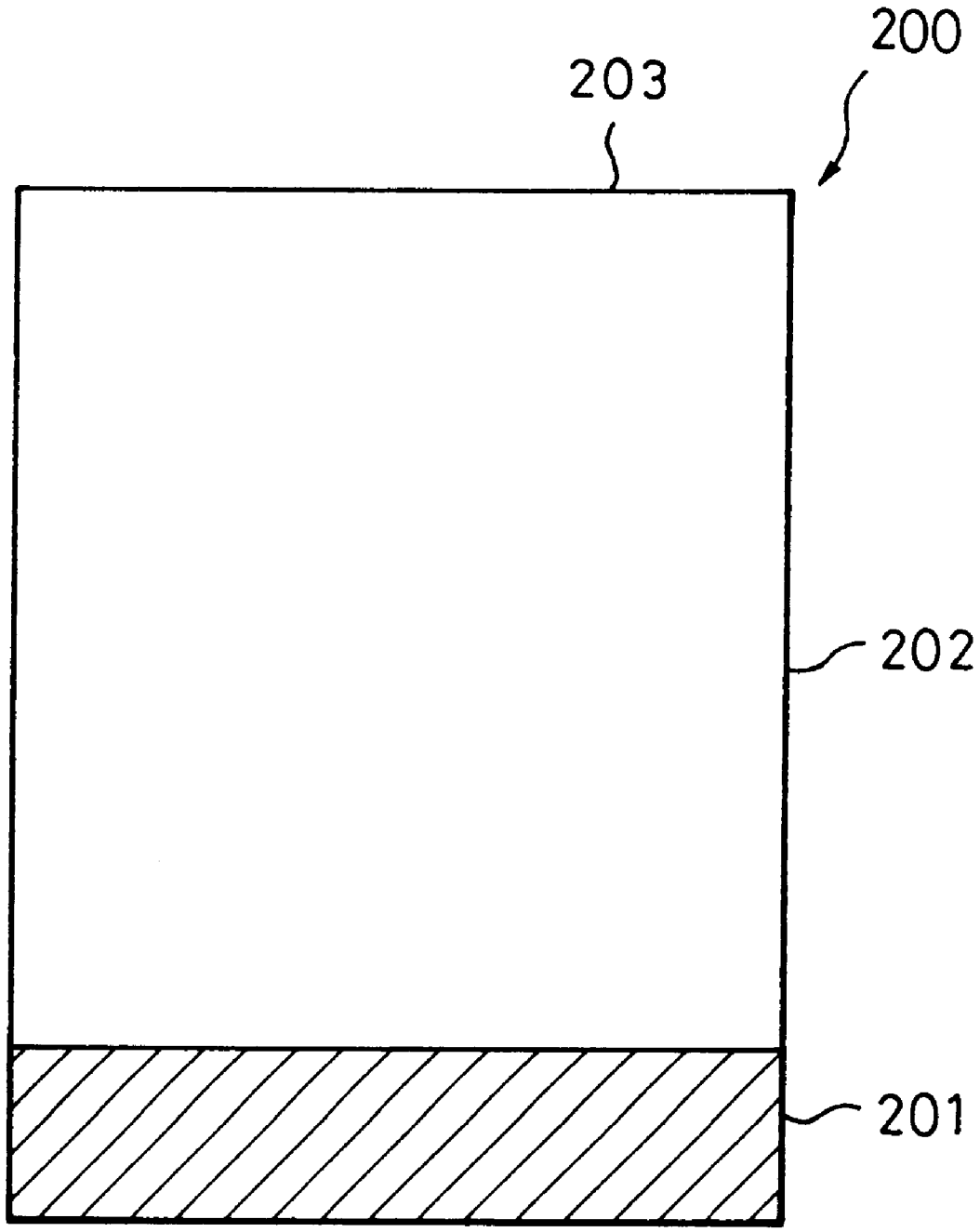
FIG. 1 is a schematic structural view which illustrates the layer structure of a prior art light receiving member for electrophotography.

In order to achieve the foregoing objectives, a light receiving member for electrophotography according to the present invention comprises in sequence: a supporting member and a light receiving layers; said light receiving layer comprising in sequence at least a photoconductive layer and a surface layer thereon, said photoconductive layer comprising a non-single-crystal material containing silicon atoms as a matrix and said surface layer comprising an amorphous material containing silicon atoms and carbon atoms as a matrix, wherein the carbon atoms are at least diamond-bonded and graphite-bonded, and wherein from 2% to 30% by number of the carbon atoms are graphite bonded.

In order to achieve the foregoing objects, a light receiving member for electrophotography according to the present invention comprises: a electrically conductive supporting member; a photoconductive layer; and a charge injection inhibiting layer between said electrically conductive supporting member and said photoconductive layer and having a function of inhibiting injection of carriers from said supporting member side into said photoconductive layer, wherein said photoconductive layer and said charge injection inhibiting layer are each a non-single-crystal material mainly composed of silicon and containing hydrogen, said photoconductive layer has a reduced polarity p-type conduction when said light receiving member for electrophotography is positively charged and has a reduced polarity n-type conduction when said light receiving member for electrophotography is negatively charged, said charge injection inhibiting layer has a reduced polarity type conduction when said light receiving member for electrophotography is positively charged and has a reduced polarity n-type conduction when said light receiving member for electrophotography is negatively charged, and said charge injection inhibiting layer has a density of states from $1\times10^{17}$ $cm^{-3}$ to $5\times10^{19}$ $cm^{-3}$.

The foregoing problems can be overcome by an interface evaluation system of a type measuring the interface steepness of stacked films by a secondary ion mass spectrometry, said interface evaluation system comprising: a unit for calculating the scatter, which is the reference of the interface steepness, from a result of a secondary ion mass spectrometry of a subject element in the direction of the thickness; and a calculating unit for displaying said scatter with respect to the subject parameter of the secondary ion mass spectrometry.

The thus-designed light receiving member for electrophotography according to the present invention is able to overcome the foregoing problems and exhibit excellent electrical, optical, photoconductive characteristics, durability and environmental resistance.

The system for evaluating the interfaces by means of the SIMS enables the steepness of the interfaces of the multilayer film to be evaluated accurately.

It is preferable that the reduced polarity p-type or reduced polarity n-type photoconductive layer and the reduced polarity p-type or reduced polarity n-type charge injection inhibiting layer have a difference (hereinafter expressed as "ΔE") between half of the optical band gap and the activation energy from 0.01 eV to 0.3 eV.

It is preferable that said photoconductive layer has a dark resistivity of $5\times10^{9}$ Ωcm or more.

It is preferable that said photoconductive layer be 1 to 70 m in thickness and said charge injection inhibiting layer be 0.1 to 5 μm in thickness.

The density of states can be controlled by causing at least one of oxygen, nitrogen and carbon to be contained in the charge injection inhibiting layer.

If necessary, a charge injection inhibiting layer for preventing injection of carriers into the upper portion of the photoconductive layer may be formed.

As a result of studies performed by the inventors of the present invention to overcome the foregoing problems, it was found that the object of the present invention can be achieved if the state where the carbon atoms are contained in the surface layer is limited. The process of conceiving the present invention will now be described.

First, the inventors of the present invention researched the cause of the lowering of the copy density of the electrophotography apparatus using the conventional light receiving member for electrophotography. When using a convention light receiving members, the surface becomes cloudy if a corona charge is made by a charger in an environment where the organic solvent vapor concentration is relatively high. The copy transfer deteriorates in the cloudy portion, causing the copy density to be lowered.

The inventors of the present invention believe that the surface cloudiness is a result of the corona charge causing vapor of the organic solvent to react with water and oxygen in air so as to be adsorbed by the material of the light receiving member, therefore lowering its resistance. Although the cloudy portion can be removed by wiping the surface with water or an organic solvent or the like, the necessity of performing the removal is undesirable Therefore, a light receiving member which is stable regardless of the environment is desirable.

Hitherto, formation of non-single-crystal material containing silicon atoms, carbon atoms and hydrogen atoms on the surface of the a-Si light receiving member has enabled the electrical, optical, photoconductive, environmental characteristics and the durability to be improved. It has been considered preferable that carbon atoms in the surface layer be present in quantities from $1\times10^{-3}$ to 90 atomic %, more preferably 10 atomic % to 80 atomic %, assuming that the total amount of silicon atoms is 100. However, the surface layer has actually been formed regardless of whether the carbon atoms are bonded.

Although amorphous carbon is a region containing carbon atoms at a high concentration, it is not effective to simply increase carbon atoms in the raw material gas because regions in which carbon atoms are present at high concentrations are increased in the mosaic form. It has been difficult to manufacture amorphous carbon and to distribute the same at an adequate proportion.

Moreover, increase in the content of carbon atoms cannot improve the charging performance, narrows the engineering band gap width and weakens the mechanical strength.

In the investigations performed by the inventors of the present invention, the chemical bonded state, which had not before been considered, was examined. As a result, it has been found that while mixing of amorphous silicon and amorphous carbon with each other while preventing deterioration of their various properties is important, the foregoing mixture is impossible for the conventional technology. It is a known fact that the number of carbon atoms that can be bonded becomes different due to difference in the hybridized orbit such as sp3 or sp2. The inventors of the present invention found that mixing of the carbon bonded state in the amorphous carbon regions is an important factor. It was also found that use of a film of the foregoing type in the surface layer of the light receiving member for electrophotography realizes excellent durability while maintaining image quality in an adverse environment.

DESCRIPTION OF THE PREFERRED EMBODIMENTS

An example of a preferred light receiving member for electrophotography will now be described with reference to the drawings.

Figure 2:
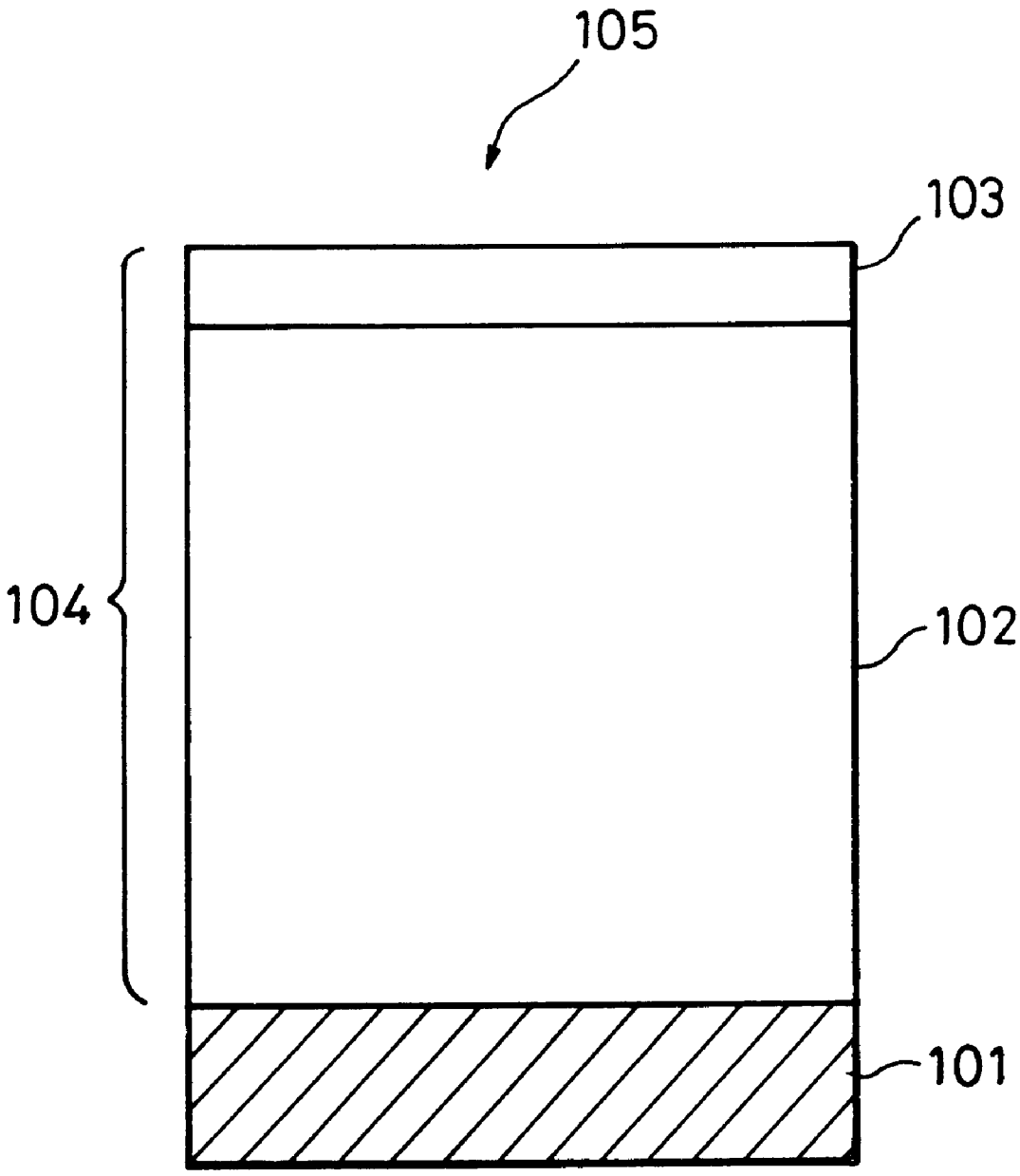
FIGS. 2 and 3 respectively are schematic structural views which illustrate the layer structure of an embodiment of a light receiving member for electrophotography according to the present invention.

FIG. 2 is a schematic structural view which illustrates the layer structure of an embodiment of the light receiving member for electrophotography according to the present invention.

A light receiving member 105 for electrophotography shown in FIG. 2 has a structure in which a light receiving layer 104 is formed on a supporting member 101 formed as a light receiving member. The light receiving layer 104 comprises a photoconductive layer 102 made of a-Si (H, X) (an amorphous material comprised silicon atoms as a matrix and hydrogen atoms and/or halogen atoms) having photoconductivity and a surface layer 103. The surface layer 103 is made of non-single-crystal material, composed of silicon atoms and carbon atoms as a matrix and which contains at least one of hydrogen atoms and fluorine atoms, wherein the carbon atoms are diamond-bonded and graphite-bonded.

The graphite-bonded carbon atoms are from 2% to 30% of the carbon atoms contained in the surface layer.

The supporting member may be made of electrically conductive material or insulative material. The conductive supporting member is exemplified by metal or alloy selected from a group consisting of Ni, Cr, stainless steel, Al, Mo, Au, Nb, Ta, V, Ti, Pt, Pb and Fe. In particular, it is preferable to employ aluminum (Al) because it exhibits adequate strength, excellent processability, and easiness in manufacturing and handling. If aluminum is employed to form the supporting member, it is preferable to improve the ease of cutting by adding 1 to 10 wt % magnesium. The purity of aluminum before magnesium is added is made to be 98 wt % or higher, preferably 99 wt % in this embodiment. The electrically insulative supporting member made of a synthetic film or a sheet of polyester, polyethylene, polycarbonate, cellulose acetate, polypropylene, polyvinyl chloride, polystyrene or polyamide may have a surface subjected to a conductive process on which the light receiving layer will be formed. It is preferable to make conductive the surface opposite the side on which the light receiving layer will be formed.

The supporting member 101 may have a flat and smooth surface or may be formed into a cylindrical shape having an uneven surface thereof or formed into a plate-like endless belt shape. The thickness of the supporting member 101 is so determined as to be capable of forming a desired light receiving member for electrophotography. If the light receiving member 105 for electrophotography must have flexibility, the supporting member may be thinned as much as possible so far as the function as the supporting member can be attained. However, the necessity of ease of manufacturing and handling of the supporting member 101 usually causes the thickness to be 10 $\mu$m or thicker. If the light receiving member 105 shown in FIG. 2 is used as the image forming member for electrophotography, it is preferable to form it into an endless belt shape or a cylindrical shape in the case where a continuous high speed copying is performed.

If an image is recorded by using coherent light such as laser beams, image defects due to an interference fringe pattern appearing in a visible image may be prevented by forming an uneven surface in the supporting member 101. The uneven surface can be formed on the surface by known methods as disclosed in Japanese Patent Application Laid-Open No. 60-168156, Japanese Patent Application Laid-Open No. 60-178457 and Japanese Patent Application Laid-Open No. 60-225854. Another method for preventing the defective image may be employed in which a plurality of spherical dimple marks are used to form the uneven surface in the surface of the supporting member 101 by a known method disclosed in Japanese Patent Application Laid-Open No. 61-231561. That is, the supporting member has an uneven surface which is smaller than the resolving power needed for the light receiving member 105 for electrophotography.

The surface layer according to the present invention is preferably formed by amorphous material containing silicon atoms, carbon atoms, hydrogen atoms and halogen atoms, more preferably amorphous material containing silicon atoms, carbon atoms, hydrogen atoms and fluorine atoms (a-$(Si_xC_y)tH_uF_v$ (where x+y=1, t+u+v=1)). The surface layer is formed by an RF discharge method or microwave discharge method or the like. In any case, reactions must be controlled such that the ratio of the number of carbon atoms which are graphite-bonded to all carbon atoms in the surface layer is different from the conventional ratio.

In the case where the plasma CVD method, such as the RF discharge method or the microwave discharge method, is employed, the control of bonding of silicon atoms can be performed by combining a selection of raw material gas source, a method in which bias is added to form an electric field during the discharge and the film forming conditions, such as power.

The surface layer, which is the characteristic of the present invention, is formed in such a manner that the raw material gas is formed by mixing ethylene ($C_2H_4$) gas or tetraethyl silane ($Si(C_2H_5)_4$) gas at an arbitrary rate, the mixed gas is previously excited with heat, light or electric fields, gas, such as silane ($SiH_4$) or silicon tetrafluoride ($SiF_4$) gas, containing silicon atoms and/or gas, such as methane ($CH_4$) or carbon tetrafluoride ($CF_4$) gas, containing carbon atoms is introduced, and the microwave discharge is performed so that the surface layer is formed. As a result, the reaction could be controlled so that carbon atoms contained in the surface layer are composed of carbon atoms to be diamond-bonded and graphite-bonded and the number of carbon atoms to be graphite-bonded is larger than all carbon atoms contained in the surface layer. A consideration is made that the foregoing control effect can be improved in the microwave discharge method by employing a method of forming an electric field in the discharge space to cause ions to effectively reach the surface of the supporting member in addition to the foregoing method.

A dilution gas for use at the time of forming the surface layer is made of hydrogen ($H_2$), argon (Ar) or helium (He) or the like. The present invention is effective if any one of the following gas or their mixture gas is introduced at the time of forming the surface layer: raw material gas containing nitrogen atoms, such as nitrogen ($N_2$) or ammonia ($NH_3$) gas; raw material gas containing oxygen atoms, such as oxygen ($O_2$), nitrogen monoxide (NO), nitrogen dioxide ($NO_2$), dinitrogen monoxide ($N_2O$), carbon monoxide (CO) or carbon dioxide ($CO_2$) gas; and dopant gas such as diborane ($B_2H_6$), boron fluoride ($BF_3$) or phosphine ($PH_3$) gas.

The temperature of the supporting member at the time of forming the surface layer for effectively achieving the object of the present invention must be optimally selected to be adaptable to the employed method of forming the surface layer. It is preferable to heat it to 100 to 400° C., more preferably 150 to 350° C. It is advantageous to employ the microwave discharge method to form the surface layer because the composition ratio of atoms forming the layers can be precisely controlled and the thickness of each layer can easily be controlled as compared with the other methods. The discharge power to be supplied at the time of forming the layers and the pressure in the reaction chamber are, in addition to the temperature of the supporting member, important factors which affect the characteristics of a-$((Si_xC_y)tH_uF_v$ to be manufactured.

It is preferable that the discharge power range from 10 to 5000 W, more preferably 20 to 2000 W, for each supporting member for the purpose of effectively forming a-$(Si_xC_y)tH_uF_v$ having the characteristics capable of achieving the objects of the present invention while maintaining excellent manufacturing yield. It is preferable that the gas pressure in the reaction chamber at the time of performing the RF discharge method range from 0.01 to 2 Torr, more preferably 0.1 to 1 Torr. When the microwave discharge method is employed, it is preferable that it ranges from 0.2 mTorr to 100 mTorr, more preferably 1 mTorr to 50 mTorr.

Although the foregoing preferred ranges of the temperature of the supporting member and the discharge power for forming the surface layer according to the present invention are employed, it is preferable that the foregoing layer forming factors are determined to be optimum values depending upon the mutual and organized relationship of the factors in place of individually determining the foregoing factors in order to form the surface layer having desired characteristics.

The surface layer according to the present invention must be formed carefully to obtain desired characteristics.

The quantity of carbon atoms and that of hydrogen atoms contained in the surface layer of the light receiving member for electrophotography are, similarly to the surface layer forming conditions, important factors to form the surface layer having the desired characteristics for achieving the objects of the present invention.

The carbon atoms contained in the surface layer are present in quantities from 40 atomic % to 90 atomic % of the total quantity of the sum of silicon atoms and carbon atoms, preferably 50 atomic % or more and as well as 90 atomic % or less, more preferably 60 atomic % or more and as well as 90 atomic % or less.

The contained hydrogen atoms are usually present in quantities from 41 to 70 atomic % of the total quantity of all elements, preferably 45 to 60 atomic %. The contained fluorine atoms are usually present in quantities from 0.11 to 10 atomic %, preferably 0.6 to 4 atomic %. The light receiving member containing hydrogen and fluorine in a quantity ranging the forgoing values is a significantly advantageous member that has not been available.

It is preferable that the composition of atoms in the surface layer according to the present invention be expressed in the form of a-$(Si_xC_y)tH_uF_v$, wherein, x ranges from 0.1 to 0.6, y ranges from 0.4 to 0.9 (where x+y=1), t ranges from 0.299 to 0.589, u ranges from 0.41 to 0.7 and v ranges from 0.001 to 0.1 (where t+u+v=1). In addition to the foregoing elements, the surface layer may contain other atoms so far as the quantity of the atoms is very small (preferably 10 atomic % or less, more preferably 3 atomic % or less, most preferably 1 atomic % or less).

If the composition in the surface layer deviates from the foregoing range, problems of strength, transparency, durability or weathering resistance of the surface layer arise and the effect of the present invention deteriorates critically.

The state in which carbon atoms are bonded to one another in the surface layer is an important factor. In order to obtain the effect of the present invention, contained carbon atoms must consist of at least diamond-bonded and graphite-bonded carbon atoms. Further, it is preferable that from 2% to 30% by number of carbon atoms are graphite-bonded in the surface layer, preferably from 12% to 18%.

The thickness of the surface layer according to the present invention must be determined adequately to effectively achieve the object of the present invention.

The thickness of the surface layer must determined while considering the organic relationship with the thickness of the photoconductive layer to meet various desires that must be met by each layer region. Further, it must be determined while considering the economical view points of manufacturing yield and the facility of mass production.

It is preferable that said surface layer be 0.01 to 10 $\mu$m in thickness, preferably 0.04 to 5 $\mu$m and most preferably 0.05 to 3 $\mu$m.

The light receiving member for electrophotography according to the present invention is adequately determined to be capable of achieving the stated object. It is preferable that the light receiving member ranges from 1 to 100 $\mu$m in thickness, more preferably 1 to 80 $\mu$m, and most preferably 2 to 50 $\mu$m.

The light receiving member for electrophotography according to the present invention may have a contact layer composed of amorphous material comprising, for example: (a) at least one of hydrogen atoms and halogen atoms, (b) at least one of nitrogen atoms and oxygen atoms, and (c) silicon atoms. The contact layer is present between the supporting member and the photoconductive layer.

Figure 3:
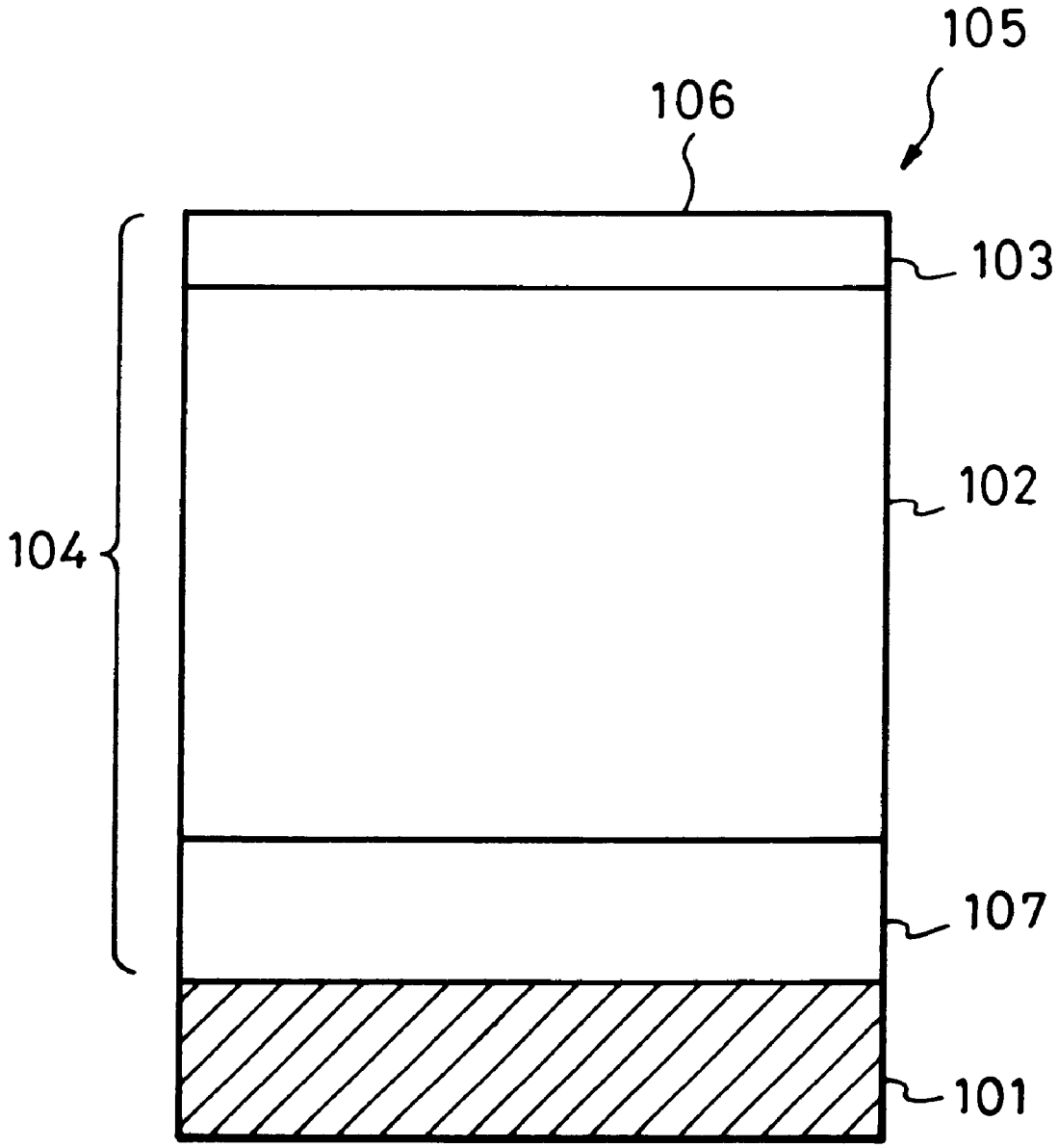

FIG. 3 is a schematic structural view which illustrates the layer structure of another embodiment of the light receiving member for electrophotography according to the present invention. A light receiving member 105 for electrophotography shown in FIG. 3 comprises, a conductive supporting member 101 serving as the light receiving member for electrophotography, a light receiving layer 104 consisting of a charge injection inhibiting layer 107 made of a-Si, a light conductive layer 102 made of a-Si, a protection layer which is formed if necessary, and a surface layer 103 serving as a charge injection inhibiting layer. The light receiving layer 104 has a free surface 106.

The light conductive layer 102 shown in FIG. 3 makes the multiple carriers have the same polarity as the charged polarity to lengthen the light carriers generated due to the image exposure so that the running characteristics are improved. Therefore, the residual potential and the sensitivity can be improved, and particularly the light memory can significantly be reduced. Since the Fermi level of the photoconductive layer 102 deviates from the center of the optical band gap, the dark resistance is reduced. Therefore, the light conductive layer 102 of the light receiving member shown in FIG. 3 is arranged to have a relatively low resistance as compared with the conventional member. In order to obtain the effect of the present invention, it is preferable that the difference from the half of the optical band gap and the activation energy be 0.1 to 0.3 eV or less. Further, it is preferable that the dark resistivity be $5\times10^9$ Ωcm or more, more preferably $10^{10}$ Ωcm or more. If the foregoing values are satisfied, the charging performance and the optical memory can simultaneously be improved.

The thickness of the light conductive layer 102 of the light receiving member shown in FIG. 3 is determined adequately to be adaptable to the process speed and the object of the electrophotographic apparatus. It is preferable to be 1 to 70 $\mu$m in thickness, more preferably 2 to 50 $\mu$m. The foregoing thickness is also applied to the light receiving member having the structure shown in FIG. 2.

The charge injection inhibiting layer 107 shown in FIG. 3 has the same polarity conduction type as that of the photoconductive layer 102. Further, it has p-type or n-type, the intensity of the conduction type of which is the same or weaker than that of the photoconductive layer 102. In addition, the charge injection inhibiting layer 107 has an adequate density of states to prevent injection of carriers from the supporting member into the photoconductive layer 102. Hitherto, a conventional photosensitive member having the prevention capability using a depletion layer has a tendency that the electric field in the photoconductive layer 102 is weakened because the major portion of the charged electric field reaches the foregoing depletion layer. In this case, the running characteristics of the optical carriers are sometimes unsatisfactory in the photoconductive layer 102. The unsatisfactory running characteristics of the optical carriers is exaggerated when adapted to a high speed process. As a result, the fine difference in the quality of the film in each portion of the photosensitive member is excessively reflected, causing the nonuniform density of the half tone image, that is, roughness. In order to prevent the foregoing phenomenon, the charge injection inhibiting layer 107 according to the present invention has the conduction type having the same polarity as that of the photoconductive layer 102. Further, the intensity of the same is made to be substantially the same as that of the photoconductive layer 102. Therefore, the structure capable of preventing the generation of the depletion layer is realized. Further, an adequate density of states is set in the charge injection inhibiting layer 107. As a result, the injected carriers from the supporting member are caught so that a spatial charge is formed. Therefore, inhibition capability is obtained. As a result of employing the foregoing structure, no depletion layer is generated in the interface between the photoconductive layer 102 and the charge injection inhibiting layer 107. Therefore, the foregoing problem can be overcome. Since the same conduction type having the same polarity as that of the charged polarity is provided, satisfactory running characteristics of the optical carrier are realized. Therefore, the residual potential and the sensitivity can be improved.

If the density of states of the charge injection inhibiting layer 107 for obtaining the foregoing effect is too high, the running characteristics of the optical carrier deteriorate, causing the residual potential to arise. Further, hopping conduction takes place causing the injection from the supporting member to increase. Therefore, it is preferable that the density be $5\times10^{19}$ $cm^{-3}$ or lower. If the density of states is too low, the inhibition performance deteriorates. Therefore, it is preferable that the density be $1\times10^{17}$ $cm^{-3}$ or higher. The desired density of states can be realized by controlling the film forming conditions, for example, the temperature of the supporting member, electric power and the degree of vacuum and the like. It can also be controlled to a certain level by adjusting the quantity of impurities to be doped to control the conduction type. It is preferable in this case that the difference $\Delta E$ between half of the band gap and the activation energy be 0.01 to 0.3 eV or less. By containing any one or all of oxygen, nitrogen and carbon or their mixture, the density of states can be controlled. It can also be controlled by adjusting the type and the flow of the raw material gas.

In the case where a-Si is used, the density of states can usually be measured by "photothermal deflection spectroscopy (PDS)" or "constant photocurrent method (CPM)". Although the density of states is obtained by mainly using the CPM, the PDS is partially used when samples having high density of states are measured. The thinnest thickness of the charge injection inhibiting layer is made to be a value with which the injection of the carrier from the supporting member 101 can satisfactorily be inhibited. Although the thickness is of course correlated with the density of states of the charge injection inhibiting layer 107, it is preferable that the thickness ranges from 0.1 $\mu$m or more, more preferably 0.5 $\mu$m or more in order to obtain the effect of the present invention. The upper limit of the thickness is determined to be adaptable to desired charging performance and the residual potential of the photosensitive member for electrophotography. It is preferable to make it to be 5 $\mu$m, more preferably 3 $\mu$m.

The photoconductive layer 102 and the charge injection inhibiting layer 107 are able to contain hydrogen by introducing hydrogen in the form of a silicon compound such as a silane exemplified by $SiH_4$ and $Si_2H_6$, and by decomposing the foregoing compound by a glow discharge plasma CVD method so that hydrogen can automatically be contained with the growth of the film. As an alternative to this, a film containing hydrogen can be formed by forming a film in a hydrogen atmosphere by a reactive sputtering method.

In accordance with the knowledge found by the inventors of the present invention, the content of hydrogen in the photoconductive layer 102 and the charge injection inhibiting layer 107 is a very important factor which determines whether or not the formed photosensitive member 105 is able to be actually applied. The photoconductive layer 102 and the charge injection inhibiting layer 107 can be made effective in actual use when the quantity of hydrogen contained in each layer is present in quantities from 1 to 40 atomic %, more preferably from 5 to 30 atomic %. The quantity of hydrogen to be contained in each layer can be controlled by adjusting the temperature of the supporting member at the time of forming the film and/or the quantity of a starting material for use to cause hydrogen to be introduced into a deposition apparatus and the discharging power.

The photoconductive layer 102 and the charge injection inhibiting layer 107 can be made to be p-type or n-type by introducing, with the other gas, atoms for controlling the conductivity, for example, Group III atoms or Group V atoms into the deposition apparatus at the time of forming the layer. Atoms for controlling the conductivity are exemplified by so-called impurities in the semiconductor field. Group III atoms in the Periodic Table (hereinafter expressed as "Group III atoms) having p-type conductive characteristics and Group V atoms in the Periodic Table (hereinafter expressed as "Group V atoms) having n-type conductive characteristics may be employed.

Group III atoms are exemplified by B (boron), Al (aluminum), Ga (gallium), In (indium) and Tl (thallium). It is preferable to use B, Al or Ga. Group V atoms are exemplified by P (phosphorus), As (arsenic), Sb (antimony) and Bi (bismuth). It is preferable to use P or As.

The quantity of atoms to be contained in the photoconductive layer 102 and the charge injection inhibiting layer 107 and acting to control the conductivity must be contained to realize the foregoing Fermi level for the purpose of achieving the object of the present invention. Specifically, it is preferable that the quantity be from $1\times10^{-3}$ to $5\times10^{4}$ atomic ppm, more preferably from $1\times10^{-2}$ to $1\times10^{4}$ atomic ppm, most preferably from $1\times10^{-1}$ to $5\times10^{3}$ atomic ppm.

The photoconductive layer 102 and the charge injection inhibiting layer 107 are formed by the vacuum deposition film forming method while determining the numerical conditions of the film forming parameter for the purpose of obtaining desired characteristics. Specifically, a thin film depositing method may be selected from a group consisting of a glow discharge method (an AC discharge CVD method, such as a low frequency CVD method, a high frequency CVD method or a microwave CVD method or a DC discharge CVD method), a sputtering method, a vacuum evaporation method, an ion plating method, a light CVD method and a heat CVD method. An adequate thin film deposition may be employed depending upon the manufacturing conditions, degree of load under invested capital in plant and equipment, the manufacturing scale, and characteristics needed for the formed photosensitive member for electrophotography. It is preferable to employ the glow discharge method, the sputtering method or the ion plating method because the conditions can relatively easily be controlled at the time of manufacturing the photosensitive member for electrophotography having desired characteristics. The foregoing methods may be employed simultaneously in one apparatus system.

The conductive supporting member 101 for use in the light receiving member shown in FIG. 2 may be the foregoing supporting member.

The surface layer 103, if necessary formed in the light receiving member shown in FIG. 3, serves as a protection layer for improving the surface hardness and the wear resistance and also serves as a charge injection inhibiting layer for inhibiting injection of the charge into the photoconductive layer to improve the charging performance. The material for the surface layer 103 is typified by a non-single-crystal material, such as Si, SiC, SiN or SiO, an inorganic insulating compound such as $Al_2O_3$, SiO or $SiO_2$ and an organic insulating compound such as polyethylene, polycarbonate, polyurethane or Parylene. The surface layer 103 is usually 0.1 $\mu$m to 2 $\mu$m in thickness.

It is of course preferable to use the surface layer of the light receiving member shown in FIG. 2 as the surface layer of the light receiving member shown in FIG. 3. In particular, the application of the surface layer of the light receiving member shown in FIG. 2 to the surface layer of the light receiving member shown in FIG. 3 enables a significantly satisfactory effect to be obtained because stable images can be obtained even under adverse environments. Also a light receiving member for electrophotography can be obtained which is able to overcome the problems of the charging performance, residual potential, sensitivity and the optical memory occurring in a high speed process.

The charge injection inhibiting layer, the photoconductive layer and the surface layer according to the present invention may contain any one type of elements selected from Groups Ia, IIa, VIa or VIII of the Periodic Table in a quantity corresponding to a contamination. The selected element may be distributed uniformly in the photoconductive layer or distributed nonuniformly in the direction of the thickness of the layer though the content is uniform in the photoconductive layer. Group Ia atoms are exemplified by Li (lithium), Na (sodium) and K (potassium). The Group IIa atoms are exemplified by Be (berylium), Mg (magnesium), Ca (calcium), Sr (strontium) and Ba (barium). The Group VIa atoms are exemplified by Fe (iron), Co (cobalt) and Ni (nickel).

Figure 4:
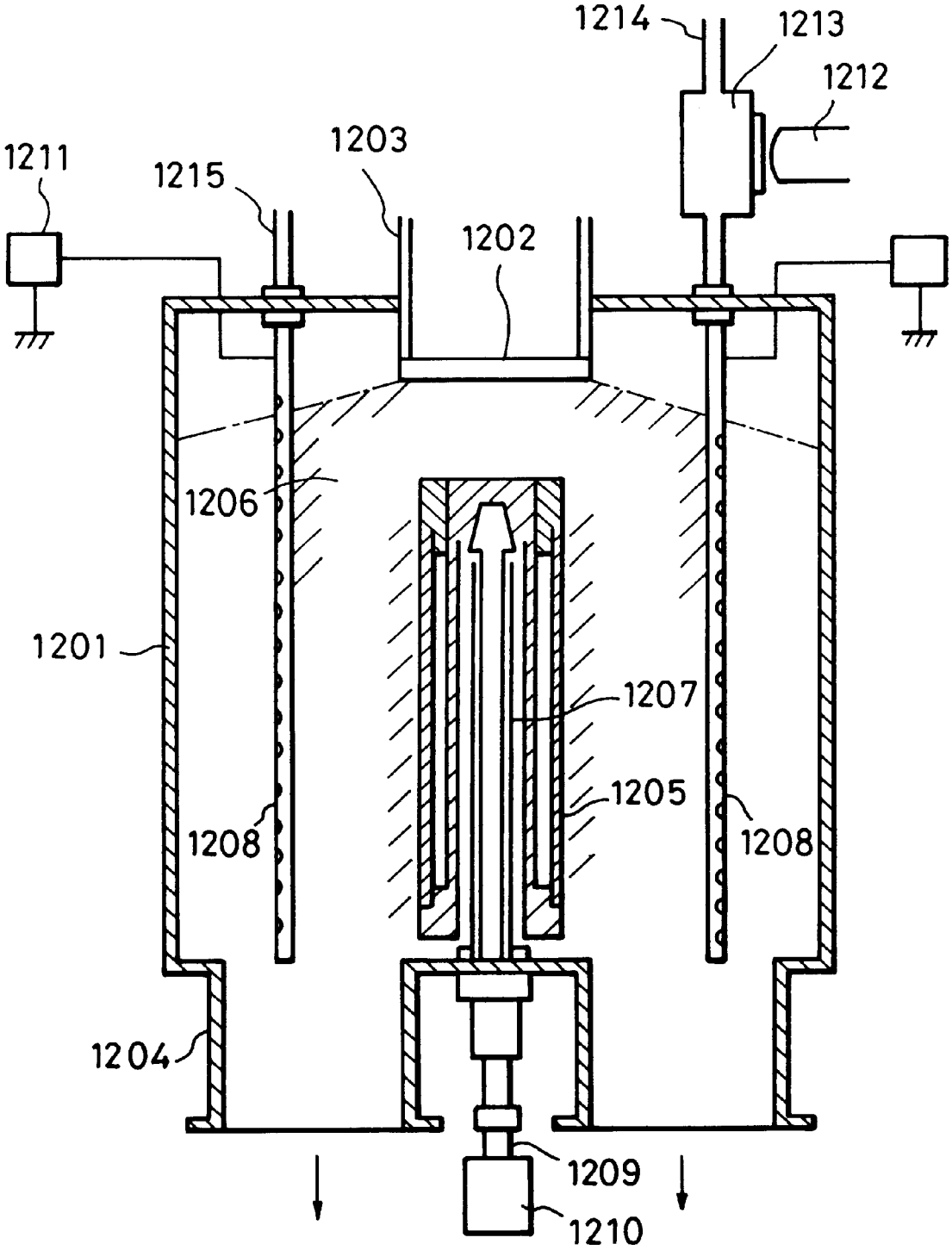
FIG. 4 is a schematic vertical cross sectional view which illustrates a microwave discharge apparatus for manufacturing the light receiving member for electrophotography according to the present invention.
Figure 5:
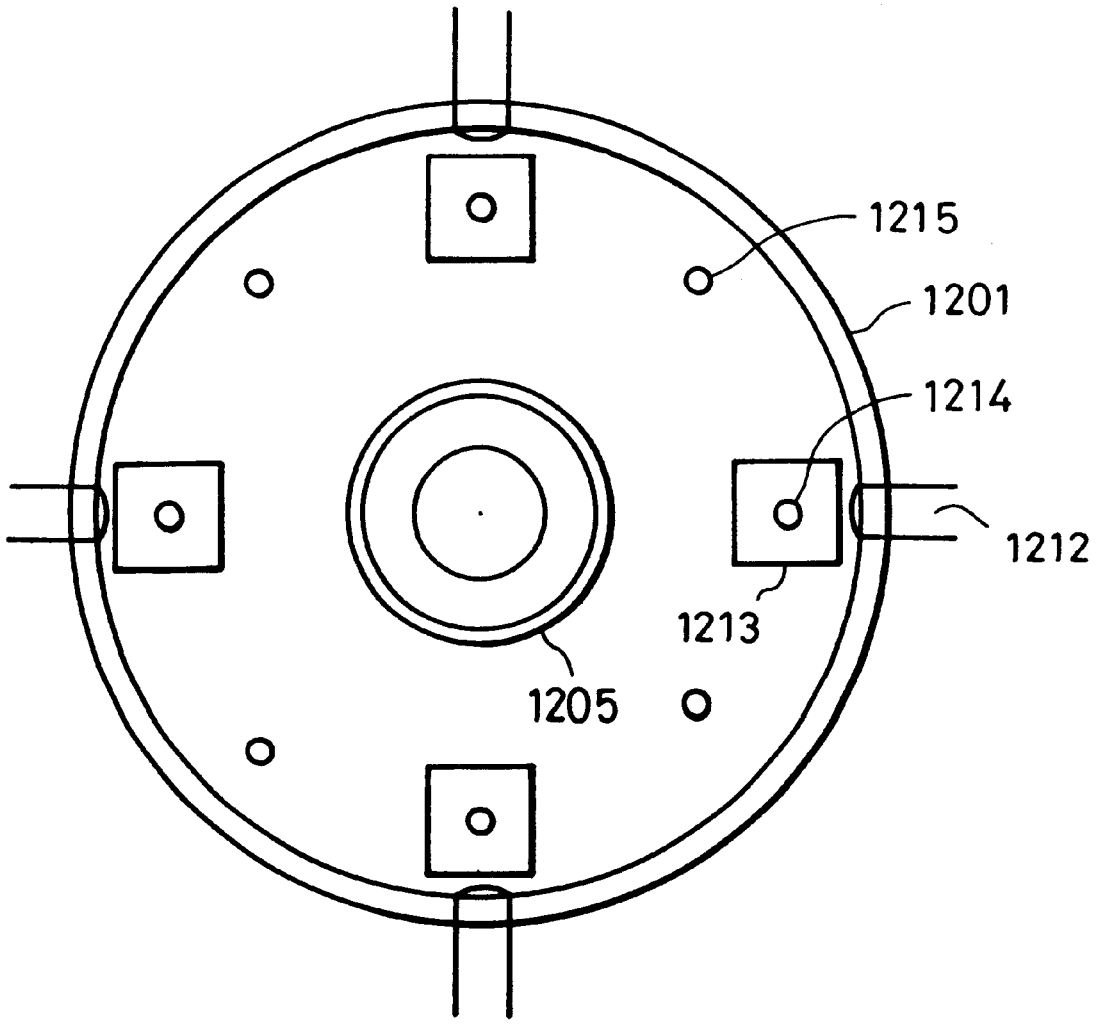
FIG. 5 is a schematic lateral cross sectional view which illustrates a microwave discharge apparatus for manufacturing the light receiving member for electrophotography according to the present invention.

FIGS. 4 and 5 respectively illustrate an apparatus for manufacturing the light receiving member for electrophotography by the microwave discharge method using the cylindrical supporting member. FIG. 4 is a vertical cross sectional view which illustrates the apparatus adapted to the microwave discharge method, and FIG. 5 is a lateral cross sectional view of the same. Referring to FIGS. 4 and 5, reference numeral 1201 represents a reaction chamber formed into a hermetic vacuum structure. Reference numeral 1202 represents a microwave introduction window made of material (for example, quartz glass or alumina ceramics) through which microwave power is efficiently passed into the reaction chamber 1201 and which is able to hermetically retain the vacuum state. Reference numeral 1203 represents a wave guide pipe for transmitting the microwave power, the wave guide pipe 1203 being composed of a rectangular portion formed from the microwave power source to the position adjacent to the reaction chamber and a cylindrical portion inserted into the reaction chamber.

The wave guide pipe 1203 is, together with a stub tuner (omitted from illustration) and an isolator (omitted from illustration), connected to a microwave power source (omitted from illustration). The microwave introduction window 1202 is hermetically sealed to the inner wall of the cylindrical portion of the wave guide pipe 1203 in order to maintain the ambience in the reaction camber. Reference numeral 1204 represents an exhaust hole having an end opened in the reaction chamber 1201 and another end allowed to communicate with an exhaust apparatus (omitted from illustration). Reference numeral 1206 represents a discharge space surrounded by a supporting member 205. A bias power source 1211 represents a DC power source for applying DC voltage to a gas introduction pipe 1208 also serving as a bias electrode, the bias power source being electrically connected to the gas introduction pipe 1208 also serving as the bias electrode.

The light receiving member for electrophotography is manufactured as follows by using the apparatus for manufacturing the light receiving member for electrophotography. First, the internal portion of the reaction chamber 1201 is exhausted through the exhaust hole 1204 by using a vacuum pump (omitted from illustration) to lower the pressure in the reaction chamber 1201 to be $1\times10^{-7}$ Torr or lower. Then, a heater 1207 is actuated to heat the supporting member 1205 to a predetermined temperature, the thus-realized temperature being maintained. In this state, the raw material gas for forming the photoconductive layer is introduced through a gas introduction pipe 1215 by a gas introduction means (omitted from illustration). That is, silane gas serving as the raw material gas of a-Si (H, X), diborane gas serving as the doping gas to be introduced if necessary, hydrogen gas or helium gas serving as the dilution gas are introduced into the reaction chamber 1201. Simultaneously, microwaves having a frequency of 2.45 GHz are generated by a microwave power source (omitted from illustration) as to be introduced into the reaction chamber 1201 by way of the wave guide pipe 1203 and the microwave introduction window 1202. Then, the DC power source 1211 electrically connected to the gas introduction pipe 1208, also serving as the bias electrode in the discharge space 1206, is turned on to supply the DC voltage to the gas introduction pipe 1208, also serving as the bias electrode.

A method of manufacturing the light receiving member for electrophotography according to the present invention by employing, for example, the microwave discharge method will now be described. First, the DC voltage is applied from the DC power source 1211 to the supporting member 1205 through the gas introduction pipe 1208 also serving as the bias electrode. As a result, the raw material as is excited by the energy of the microwaves as to be dissociated in the discharge space 1206 surrounded by the supporting member 1205. Further, the light conductive layer is always formed on the surface of the supporting member 1205 by the electric field between the gas introduction pipe 1208 also serving as the bias electrode and the supporting member 1205. At this time, a rotational shaft 1209 to which the supporting member 1205 is fastened is rotated by a motor 1210 so that the supporting member 1205 is rotated around the central axis of the bus line thereof. As a result, a deposited film is formed uniformly on the overall surface of the supporting member 1205.

In order to form the surface layer on the thus-formed photoconductive layer, the composition of the raw material gas is changed from that employed at the time of forming the photoconductive layer and tetraethyl silane gas and ethylene gas are, in a previously exciting chamber 1213, previously excited due to light from a light source 1212 as to be introduced into the reaction chamber 1201 through the gas introduction pipe 1214. The silane gas and the fluorine gas are introduced into the reaction chamber 1201 through the gas introduction pipe 1215 and discharge is commenced similarly to the process in which the photoconductive layer is formed. At this time, the hydrogen gas and helium gas are introduced into the reaction chamber 1201 through the gas introduction pipes 1214 and 1215. The flow ratio of the dilution gas to be introduced into the gas introduction pipes 1214 and 1215 must be changed so as not to change the overall gas flow so that the same flows are passed through the two types of gas pipes.

The quantity of carbon atoms to be contained in the surface layer can be controlled by arbitrarily changing the flow ratio of the silane gas and the methane gas to be introduced into the discharge space. The state where silicon atoms are bonded can arbitrarily be controlled by replacing silane gas and methane gas by the previous-excited tetraethyl silane gas and the ethylene gas. By changing the bias voltage to be applied to the discharge space, the control can further effectively be performed. The quantity of hydrogen atoms and that of fluorine atoms to be contained in the surface layer can be controlled by arbitrarily changing the flow of hydrogen gas to be introduced into the discharge space.

An apparatus and a method of forming the deposited film by the DC discharge plasma CVD method will now be described.

Figure 6:
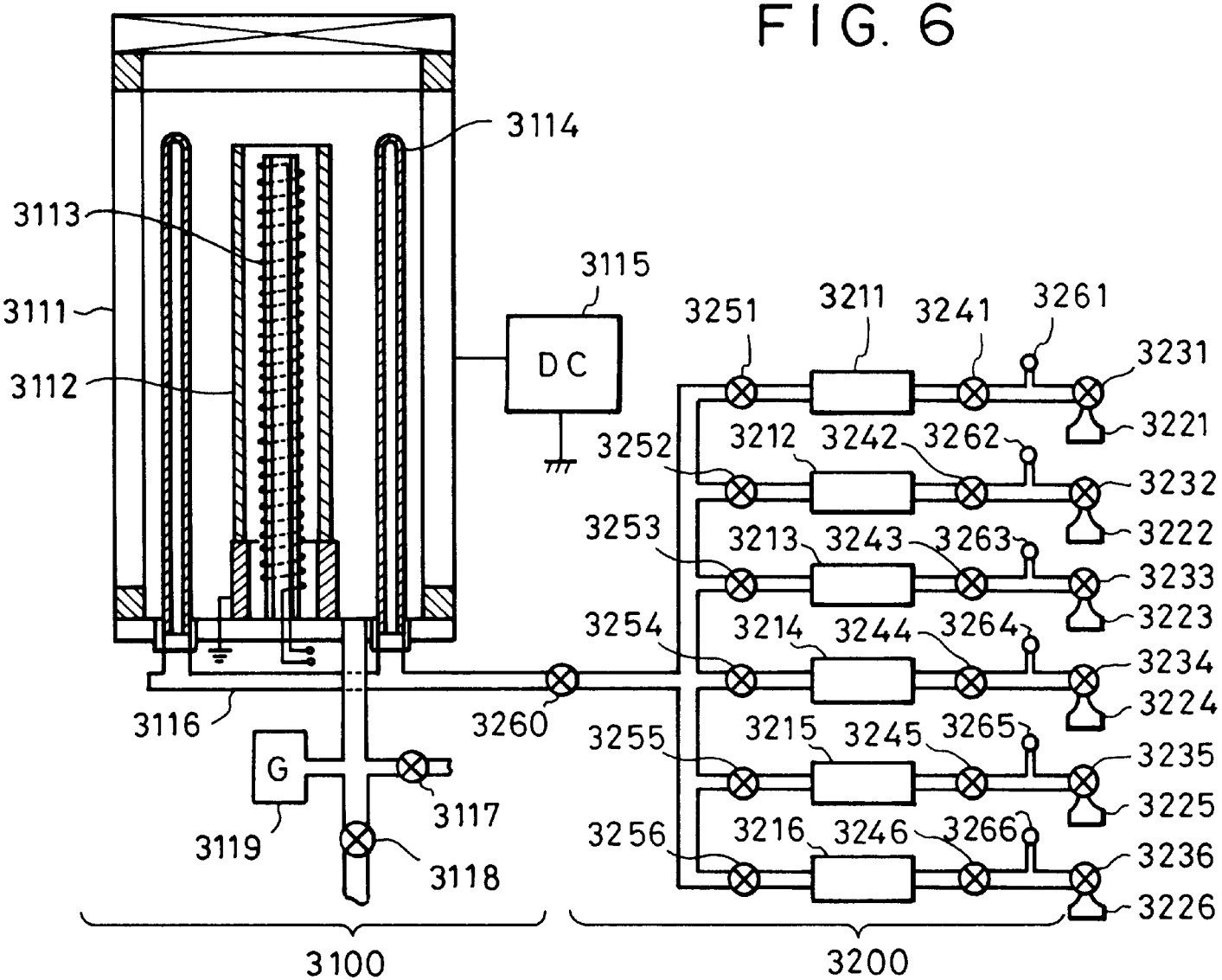
FIG. 6 is a schematic view which illustrates an example of an apparatus for forming a light receiving layer of a light receiving member for electrophotography according to the present invention adapted to a glow discharge method using DC.

FIG. 6 is a schematic structural view which illustrates an example of an apparatus for manufacturing the light receiving member for electrophotography by the DC discharge plasma CVD (hereinafter expressed as "DC-PCVD") method.

The structure of the apparatus for forming the deposited film by the DC-PCVD method shown in FIG. 6 is arranged as follows. The apparatus comprises a deposition unit 3100, a raw material gas supply unit 3200 and an exhaust unit (omitted from illustration) for lowering the pressure in a reaction chamber 3111. The reaction chamber 3111 in the deposition unit 3100 includes a cylindrical supporting member 3112, a supporting-member heater 3113 and a raw material gas introduction pipe 3114.

The raw material gas supply unit 3200 comprises raw material gas cylinders 3221 to 3226 for $SiH_4$, $H_2$, $CH_4$ (or $C_2H_4$), NO, $NH_3$ and $B_2H_6$ gases, valves 3231 to 3236, 3241 to 3246 and 3251 to 3256 and mass flow controllers 3211 to 3216. The gas cylinders are connected to the gas introduction pipe 3114 in the reaction chamber 3111 by way of the valve 3260.

The deposited film can be formed by using the foregoing apparatus as follows.

First, the cylindrical supporting member 3112 is laced in the reaction chamber 3111, and then the space in the reaction chamber 3111 is exhausted by an exhausting apparatus (for example, a vacuum pump). Then, the supporting-member heater 3113 is actuated to control the temperature of the cylindrical supporting member 3112 to a predetermined temperature level of 20° C. to 500° C.

The raw material gases for forming the deposited film are introduced into the reaction chamber 3111 by confirming that the valves 3231 to 3236 of the gas cylinders and a leak valve 3117 of the reaction chamber are closed and by confirming that the introduction valves 3241 to 3246, the discharge valves 3251 to 3256 and the sub-valve 3260 are opened. Then, the main valve 3118 is opened to exhaust gases in the reaction chamber 3111 and the gas pipe 3116.

Then, the sub-valve 3260 and the discharge valves 3251 to 3256 are closed when a vacuum meter 3199 indicates about $5\times10^{-6}$ Torr.

Then, the respective gases are introduced from the gas cylinders 3221 to 3226 by opening the valves 3231 to 3236, and pressure regulators 3261 to 3266 are used to regulate each gas pressure to 2 kg/cm$^2$. Then, the introduction valves 3241 to 3246 are gradually opened to introduce the respective gases into the mass flow controllers 3211 to 3216.

After the preparation for forming the film has been completed, the charge injection inhibiting layer and the photoconductive layer are formed on the cylindrical supporting member 3112.

When the cylindrical supporting member 3112 has been heated to a predetermined temperature level, needed valves among the discharge valves 3251 to 3256 and the sub-valve 3260 are gradually opened to introduce predetermined gases from the gas cylinders 3221 to 3226 into the reaction chamber 3111 through the gas introduction pipe 3114. Then, the mass flow controller 3211 to 3216 are used to regulate the raw material gas flows to predetermined quantities. At this time, the pressure in the reaction chamber 3111 is made to be a predetermined level which is lower than 1 Torr by adjusting an opening of the main valve 3118 while looking a vacuum meter 3119. After the internal pressure has been stabilized, the DC power source 3115 is set to a predetermined voltage level. Then, DC voltage is applied into the reaction chamber 3111 so that DC glow discharge is generated. The discharge energy causes the raw material gas introduced into the reaction chamber to be decomposed so that a desired deposited film mainly composed of silicon is formed on the cylindrical supporting member 3112. After the film having a predetermined thickness has been formed, the power supply by the DC power source 3115 is stopped and the discharge valve is closed. Thus, forming of the deposited film is completed.

By repeating similar operations, a desired light receiving layer formed into the multi-layer structure can be formed.

When the respective layers are formed, the discharge valves that are not needed must, of course, be closed. Further, leaving of the gas in the reaction chamber 3111 and the pipes from the discharge valves 3251 to 3256 to the reaction chamber 3111 must be prevented by, if necessary, closing the discharge valves 3251 to 3256, by opening the sub-valve 3260 and by fully opening the main valve 3118 to temporarily exhaust gases in the inside portion of the system.

When the film formation must be made uniform, the cylindrical supporting member 3112 is rotated at a predetermined speed by a drive device (omitted from illustration) during a period in which the film is being formed.

The foregoing gas sources and the valve operations are, of course, varied to be adaptable to the film forming conditions.

EXAMPLES

Examples and comparative examples of the light receiving member for electrophotography according to the present invention will now be described.

Example 1 and Comparative Example 1

The manufacturing apparatus shown in FIGS. 4 and 5 was used so that the light receiving member for electrophotography composed of a photoconductive layer and the surface layer as shown in FIG. 2 was formed on an aluminum cylinder having a mirror surface under manufacturing conditions shown in Tables 1 and 2. Further, samples each having only the surface formed on the same cylinder were prepared. The light receiving member was set to an electrophotography apparatus (NP6650 manufactured by Canon was modified as to be adaptable to the experiments) so that following factors were evaluated: the electrophotographic characteristics, such as the initial charging performance, sensitivity, flow of the image, residual potential and ghost image defect; and the change of the characteristics taken place after 500,000 times durability operations under environment in which the concentration of vapor of the organic solvent was relatively high. Further, drum damage after the repeated operation was evaluated.

TABLE 1

| | Layers | |
|---|---|---|
| Manufacturing Conditions | Photo-conductive Layers | Surface layer |
| Flow of Raw Material Gas | 100 sccm | *sccm |
| SiH4 | 0 sccm | *sccm |
| C2H4 | 0 sccm | *sccm |
| Si(C2H5)4 | 0 sccm | *sccm |
| CH4 | 0 sccm | *sccm |
| He | 500 sccm | 100 sccm |
| B2H6/SiH4 | 0.5 ppm | 0 ppm |

TABLE 1-continued

| Manufacturing Conditions | Layers: Photo-conductive Layers | Layers: Surface layer |
|---|---|---|
| H2 | 0 sccm | 0 sccm |
| Internal Pressure | 12 mTorr | 15 mTorr |
| Intensity of Previously Exciting UV | 0 W | 254 nm (15 mW/cm$^2$) |
| Microwave Power | 300 W | 300 W |
| Bias Voltage | 90 V | 90 V |
| Thickness of Layer | 25 μm | 0.5 μm |

*is shown in Table 2

TABLE 2

| Raw Material Gas | Samples: A | B | C | D | E | F | G |
|---|---|---|---|---|---|---|---|
| $SiH_4$ (sccm) | 100 | 75 | 67 | 50 | 37 | 25 | 12 |
| $C_2H_4$ (sccm) | 0 | 10 | 20 | 30 | 40 | 50 | 60 |
| $Si(C_2H_5)_4$ (sccm) | 0 | 75 | 65 | 55 | 45 | 35 | 25 |
| $CH_4$ sccm | 200 | 185 | 170 | 155 | 140 | 25 | 110 |

The samples (hereinafter expressed as "samples") of only the surface layers were cut to be taken out to correspond to the upper and lower portions of the image portion to analyze the state where carbons were bonded by Raman scattering.

The results of the evaluations and analyzed values of the samples are shown in Tables 3 and 4.

As can be understood from Tables 3 and 4, significantly satisfactory results were obtained if the surface layer met the conditions where the values of C (C=C)/C (total) ranged from 2 to 30 atomic %.

TABLE 3

| Tests | Sample: A | B | C | D | E | F | G |
|---|---|---|---|---|---|---|---|
| Initial Characteristics | | | | | | | |
| Charging Performance | ○ | ○ | ○ | ◎ | ○ | ○ | Δ |
| Sensitivity | Δ | ○ | ○ | ◎ | ◎ | ○ | ○ |
| Flow of Image | ○ | ◎ | ◎ | ◎ | ◎ | ◎ | ◎ |
| Residual Potential | ◎ | ◎ | ◎ | ◎ | ◎ | ◎ | ◎ |
| Ghost | ○ | ◎ | ◎ | ◎ | ◎ | ○ | ○ |
| Image Defect | ◎ | ◎ | ◎ | ◎ | ◎ | ◎ | ◎ |
| After Durability Under Test Environment | | | | | | | |
| Charging Performance | Δ | ○ | ○ | ◎ | ○ | ○ | Δ |
| Sensitivity | Δ | Δ | ○ | ◎ | ○ | Δ | X |
| Image Flow | ○ | ◎ | ◎ | ◎ | ◎ | ◎ | ○ |
| Residual Potential | ○ | ◎ | ◎ | ◎ | ◎ | ◎ | ○ |
| Ghost | Δ | ○ | ◎ | ◎ | ○ | ○ | Δ |
| Image Defect | Δ | ○ | ◎ | ◎ | ○ | ○ | Δ |
| Toner Filming | ○ | ◎ | ◎ | ◎ | ◎ | ◎ | ○ |
| Damage of Drum Surface | ○ | ○ | ◎ | ◎ | ◎ | ◎ | ○ |

Test Condition (high concentration vapor of organic solvent)
◎ . . . Excellent
○ . . . Satisfactory
Δ . . . Allowable
X . . . Problems will arise in accordance with environment

TABLE 4

| Element | Composition Ratio (atomic %): A | B | C | D | E | F | G |
|---|---|---|---|---|---|---|---|
| Si (total) | 34.4 | 34.5 | 33.8 | 34.8 | 34.1 | 35.5 | 33.8 |
| Si (Si—C) | 14.3 | 14.0 | 13.9 | 13.6 | 13.6 | 13.7 | 14.6 |
| C (total) | 27.6 | 28.3 | 28.5 | 28.5 | 28.2 | 28.3 | 26.5 |
| C (C=C) | 0.5 | 1.4 | 2.9 | 4.4 | 5.6 | 7.0 | 7.9 |
| C (C=C) / C (total) | 1.8 | 4.9 | 10.2 | 15.4 | 19.9 | 24.7 | 30.9 |
| H | 38.0 | 37.2 | 37.7 | 36.7 | 37.7 | 36.2 | 39.7 |

Si (Si—C) . . . composition ratio of Si atoms having Si—C bond
C (C=C) . . . composition ratio of carbon atoms having C=C bond

Example 2 and Comparative Example 2

Example 2

The manufacturing apparatus shown in FIGS. 4 and 5 was used to form, on an aluminum cylinder having a mirror surface, a light receiving member for electrophotography having a layer structure composed of a light conductive layer, which had at least a charge generating layer and a charge transporting layer, and a surface layer under the conditions shown in Table 5 and the conditions for the surface layer shown in Table 2.

TABLE 5

| Manufacturing Conditions | Layers: Photoconductive Layers: Charge transporting layer | Photoconductive Layers: Charge generating layer | Surface layer |
|---|---|---|---|
| Flow of Raw Material Gas | | | |
| SiH4 | 100 sccm | 250 sccm | * |
| C2H4 | 0 sccm | 0 sccm | * |
| Si(C2H5)4 | 0 sccm | 0 sccm | * |
| CH4 | 15 sccm | 0 sccm | * |
| He | 500 sccm | 2000 sccm | 100 sccm |
| B2H6/SiH4 | 1.0 ppm | 0.5 ppm | 0 ppm |
| H2 | 150 sccm | 0 sccm | 0 sccm |
| Internal Pressure | 15 mTorr | 12 mTorr | 15 mTorr |
| Intensity of Previously Exciting UV | 0 W | 0 W | 254 nm (15 mW/cm$^2$) |
| Microwave Power | 300 W | 350 W | 300 W |
| Bias Voltage | 70 V | 90 V | 90 V |
| Thickness of Layer | 20 μm | 2 μm | 0.5 μm |

A light receiving member having an optimum surface layer (sample D) containing from 12% to 18% carbon atoms by number that are graphite-bonded was manufactured similarly to Example 1.

The manufactured light receiving member was evaluated by the copying machine (modified NP-6650 manufactured by Canon).

Comparative Example 2

A comparative light receiving member was manufactured which had a photoconductive layer formed under the conditions shown in Table 5 and a surface layer under the conditions for the sample A shown in Table 2. The foregoing comparative sample was evaluated similarly to Example 2. The results and those of other examples are shown in Table 8.

As can be understood from Tables, Example 2 resulted excellent durability under adverse environment.

Example 3

A light receiving member for electrophotography comprising a photoconductive layer, in which the carbon distribution was changed with respect to the silane distribution, and a surface layer was manufactured on an aluminum cylinder having a mirror surface by using the manufacturing apparatus shown in Tables 4 and 5 under the manufacturing conditions shown in Table 6 and the conditions for the sample D shown in Table 2.

The manufactured light receiving member was evaluated by the copying machine (modified NP-6650 manufactured by Canon) similarly to Example 1. The results are shown in Table 8.

TABLE 6

| Manufacturing Conditions | Layers: Photoconductive Layers: Base Side | Photoconductive Layers: Surface Side | Surface Layer |
|---|---|---|---|
| Flow of Raw Material Gas | | | |
| SiH4 | 120 sccm → | 100 sccm | * |
| C2H4 | 0 sccm → | 0 sccm | * |
| Si(C2H5)4 | 0 sccm → | 0 sccm | * |
| CH4 | 15 sccm → | 0 sccm | * |
| He | 50 sccm → | 400 sccm | 100 sccm |
| B2H6/SiH4 | 1.0 ppm → | 0.5 ppm | 0 ppm |
| H2 | 50 sccm → | 0 sccm | 0 sccm |
| Internal Pressure | 15 mTorr → | 12 mTorr | 15 mTorr |
| Intensity of Previously Exciting UV | 0 W | | 254 nm (15 mW/cm$^2$) |
| Microwave Power | 300 W → | 350 W | 306 W |
| Bias Voltage | 70 V → | 90 V | 90 V |
| Thickness of Layer | 25 μm | | 0.5 μm |

Comparative Example 3

A comparative light receiving member was manufactured which had a light conductive layer formed under the conditions shown in Table 6 and a surface layer formed under the surface layer conditions for the sample A shown in Table 2. The thus-manufactured sample was evaluated similarly to Example 1. The results are shown in Table 8 together with the results of Example 3.

As can be understood from Tables, Example 3 resulted superior durability under adverse environment to that of Comparative Example 3.

Example 4 and Comparative Example 4

Example 4

A light receiving member for electrophotography having a triple-layer structure composed of a charge injection inhibiting layer, a photoconductive layer and a surface layer were formed on an aluminum cylinder having a mirror surface by using the manufacturing apparatus shown in FIGS. 4 and 5 under manufacturing conditions shown in Table 7 and the surface layer conditions for the sample D shown in Table 2.

The manufactured light receiving member was evaluated by the copying machine (modified NP-6650 manufactured by Canon) similarly to Example 1. The results are shown in Table 8.

TABLE 7

| Manufacturing Conditions | Layers: Charge Injection Inhibiting Layer | Photo-conductive Layer | Surface Layer |
|---|---|---|---|
| Flow of Raw Material Gas | | | |
| SiH4 | 300 sccm | 250 sccm | * |
| C2H4 | 0 sccm | 0 sccm | * |
| Si(C2H5)4 | 0 sccm | 0 sccm | * |
| CH4 | 50 sccm | 0 sccm | * |
| He | 100 sccm | 500 sccm | 100 sccm |
| B2H6/SiH4 | 1000 ppm | 0.5 ppm | 0 ppm |
| H2 | 0 sccm | 0 sccm | 0 sccm |
| Internal Pressure | 8 mTorr | 12 mTorr | 0 mTorr |
| Intensity | 0 W | 0 W | 254 nm |
| Previously Exciting UV | | | 254 nm (15 mW/cm$^2$) |
| Microwave Power | 300 W | 350 W | 300 W |
| Bias Voltage | 100 V | 90 V | 90 V |
| Thickness of Layer | 3 μm | 25 μm | 0.5 μm |

TABLE 8

| Tests | Sample: E2 | C2 | E3 | C3 | E4 | C4 |
|---|---|---|---|---|---|---|
| Initial Characteristics | | | | | | |
| Charging Performance | ◎ | ○ | ◎ | ◎ | ◎ | ○ |
| Sensitivity | ◎ | Δ | ◎ | ◎ | ◎ | ○ |
| Flow of Image | ◎ | ○ | ◎ | ◎ | ◎ | ◎ |
| Residual Potential | ◎ | ◎ | ◎ | ◎ | ◎ | ◎ |
| Ghost | ◎ | ○ | ◎ | ◎ | ◎ | ○ |
| Image Defect | ◎ | ◎ | ◎ | ◎ | ◎ | ◎ |
| After Durability Under Test Environment | | | | | | |
| Charging Performance | ◎ | Δ | ◎ | ○ | ◎ | ○ |
| Sensitivity | ◎ | Δ | ◎ | ○ | ◎ | Δ |
| Image Flow | ◎ | ○ | ◎ | ○ | ◎ | ○ |
| Residual Potential | ◎ | ○ | ◎ | ◎ | ◎ | ○ |
| Ghost | ◎ | Δ | ◎ | Δ | ◎ | Δ |
| Image Defect | ◎ | Δ | ◎ | ○ | ◎ | Δ |
| Toner Filming | ◎ | ○ | ◎ | ○ | ◎ | ○ |
| Damage of Drum Surface | ◎ | ○ | ◎ | ○ | ◎ | ○ |

where symbol E denotes Example and C denotes Comparative Example.

Test Condition (high concentration vapor of organic solvent)

◎. . . Excellent

○. . . Satisfactory

Δ. . . Allowable x . . . Problems will arise in accordance with environment

Comparative Example 4

A comparative light receiving member was manufactured which had a charge injection inhibiting layer and the photoconductive layer formed under the conditions shown in Table 7 and the surface layer formed by the surface layer condition for the sample A shown in Table 2. The comparative sample was evaluated similarly to Example 1. The results are shown in Table 8 together with the results of Example 4.

As can be understood from Tables, Example 4 resulted superior durability under adverse environment to that of Comparative Example 4.

Example 5

An apparatus for manufacturing a light receiving member for electrophotography shown in FIG. 6 was used to manufacture a light receiving member for electrophotography for positive charge shown in FIG. 3 on an aluminum cylinder having a mirror surface in accordance with the foregoing procedure by employing the DC glow discharge method under manufacturing conditions shown in Table 9. In this embodiment, the quantity of $B_2H_6$ and that of $H_2$ at the time of forming the photoconductive layer were changed to make the values ΔE to be 0.05 eV (p-type), 0.1 eV (p-type) and 0.25 eV (p-type). ΔE of each sample was measured, and then a light receiving member for electrophotography was manufactured under the same conditions as those under which the sample having the foregoing value of ΔE was manufactured. All films exhibited dark resistivity of $5\times10^9$ Ωcm or more.

In this example, a charge injection inhibiting layer having ΔE of 0.1 eV (p-type) and a density of state of $5\times10^{17}$ $cm^{-3}$ was used.

The manufactured light receiving member for electrophotography was set to an electrophotographic apparatus obtained by modifying the copying machine NP-9800 manufactured by Canon to be adaptable to the experiments so that the charging performance at the time of positive charge, the residual potential, the optical memory (ghost) and the roughness were evaluated. The respective characteristics were evaluated as follows:

(1) Electrical Characteristics

Charging Performance: the light receiving member for electrophotography was placed in an experimental apparatus so that corona charge was performed with a high voltage level of+6 kV applied to the charger. Then, the surface potential of the dark portion of the light receiving member for electrophotography was measured by a surface potentiometer.

Residual Potential: the light receiving member for electrophotography is charged to a predetermined surface potential arranged to the dark portion. Immediately after this, strong light having a predetermined light quantity is applied. A halogen light source and a filter were used to apply light from which light having wavelengths shorter than 550 nm was excluded. At this time, the surface potential of a light portion of the light receiving member for electrophotography is measured by the surface potentiometer.

The respective characteristics are evaluated as:

⊙. . . Excellent

○. . . Satisfactory

Δ. . . No practical problem

X . . . A practical problem sometimes arises if a high speed process is performed.

(2) Evaluation of Image

Optical Memory (ghost): a ghost test chart (Part No. FY9-9040 manufactured by Canon) was used on which a black circle having a reflection density of 1.1 and a diameter of 5 mm was allowed to enter, the chart being then placed at the leading portion of the image on the original document retainer. Then, a half tone chart manufactured by Canon was superposed on it so that a copy image was formed. The difference between the reflection density of ϕ 5 mm ghost chart observed on the half tone copy and the reflection density of the half tone portion was measured.

Roughness: A half tone chart (part No. FY9-9042) manufactured by Canon was placed on an original document retainer, and then copying was performed to obtain a copy image. While making a circular region having a diameter of 0.05 mm to be a unit, image densities of 100 points were measured to evaluate the dispersion of the image densities.

The respective characteristics are evaluated as:

⊙. . . Excellent

○. . . Satisfactory

Δ. . . No practical problem

X . . . A practical problem sometimes arises if a high speed process is performed.

TABLE 9

| Layers | Gas and Flow (sccm) | DC Power (W) | Internal Pressure (Torr) | Temperature of Supporting member (° C.) | Thickness of Layer (μm) |
|---|---|---|---|---|---|
| Charge Injection Inhibiting Layer | SiH4 500<br>NO 10<br>CH4 0<br>B2H6 30 ppm<br>H2 350 | 500 | 0.5 | 290 | 3 |
| Photoconductive Layer | SiH4 500<br>B2H6 (change)<br>H2 (change) | 500 | 0.5 | 290 | 15 |
| Surface Layer | SiH4 30<br>CH4 500 | 300 | 0.3 | 290 | 0.5 |

Comparative Example 5

A light receiving member for electrophotography for positive charge was manufactured which had a charge injection inhibiting layer, a photoconductive layer and a surface layer formed in this sequential order on a supporting member thereof under the manufacturing conditions shown in Table 9 similarly to Example 5. In this comparative example, the quantity of $B_2H_6$ was changed at the time of forming the photoconductive layer with respect to Example 5 to make drums having the value of ΔE of 0 eV (i-type) and 0.1 eV (n-type) and each having a dark resistivity of $5\times10^9$ Ωcm or more and make a photosensitive member having ΔE of 0.2 eV (p-type) and a dark resistivity which was smaller than $5\times10^9$ Ωcm.

The manufactured light receiving member for electrophotography was evaluated similarly to Example 5.

The results of Example 5 and Comparative Example 5 are shown in Table 10. It can be understood that, when the conduction type of the photoconductive layer has the same polarity (p-type) as that of the charging potential, ΔE is 0.01 to 0.3 eV and the dark resistivity is $5\times10^9$ Ωcm or more, the optical memory can be improved.

TABLE 10

| | Example 5 | | | Comparative Example 5 | | |
|---|---|---|---|---|---|---|
| ΔE (eV) | 0.05 | 0.1 | 0.25 | 0 | 0.1 | 0.2 |
| Conduction Type | p | p | p | i | n | p |
| Dark Resistance | | $2 \times 10^{12}$ | $5 \times 10^{12}$ | $1 \times 10^{12}$ | $5 \times 10^{12}$ | $1 \times 10^{12}$ |
| Charging Performance | ○ | ○ | ○ | ◎ | ◎ | Δ |
| Residual Potential | ◎ | ◎ | ◎ | ○ | Δ | ◎ |
| Optical Memory (ghost) | ◎ | ◎ | ◎ | Δ | Δ | ◎ |
| Roughness | ◎ | ◎ | ◎ | Δ | Δ | ◎ |
| Total | ◎ | ◎ | ◎ | Δ | Δ | Δ |

Example 6

Similarly to Example 5, the apparatus for manufacturing the light receiving member for electrophotography shown in FIG. 6 was used so that a light receiving member for electrophotography for negative charge was manufactured under manufacturing conditions shown in Table 11. In this example, the quantity of $B_2H_6$ or that of $PH_3$ and $H_2$ were changed at the time of forming the photoconductive layer to make the value of ΔE to be 0.05 eV (n-type), 0.1 eV (n-type) and 0.25 eV (n-type). The parameter for DE was measured in such a manner that a sample was previously formed on a glass substrate so that a light receiving member for electrophotography was manufactured under the same conditions similarly to Example 1. The dark resistivity of each film had a dark resistivity of $5\times10^9$ Ωcm or more.

In this example, a charge injection inhibiting layer having ΔE of 0.3 eV (n-type) and a density of state of $5\times10^{17}$ $cm^{-3}$ was used.

The manufactured light receiving member for electrophotography was set to a copying machine NP-9800 manufactured by Canon and arranged to be adaptable to the experiment so that the charging performance at the time of the negative charge, the residual potential, roughness and ghost were evaluated similarly to Example 5.

TABLE 11

| Layers | Gas and Flow (sccm) | | DC Power (W) | Internal Pressure (Torr) | Temperature of Supporting member (° C.) | Thickness of Layer (μm) |
|---|---|---|---|---|---|---|
| Charge Injection Inhibiting Layer | SiH4 | 500 | 500 | 0.5 | 290 | 3 |
| | NO | 10 | | | | |
| | CH4 | 0 | | | | |
| | PH3 | 50 ppm | | | | |
| | H2 | 350 | | | | |
| Photoconductive Layer | SiH4 | 500 | 500 | 0.5 | 290 | 15 |
| | B2H6 or | (change) | | | | |
| | PH3 | | | | | |
| | H2 | (change) | | | | |
| Surface Layer | SiH4 | 30 | 300 | 0.3 | 290 | 0.5 |
| | NO | 500 | | | | |
| | B2H6 | 500 | | | | |

Comparative Example 6

A light receiving member for electrophotography for negative charge was manufactured under the manufacturing conditions shown in Table 2 similarly to Example 6. In this comparative example, the quantity of $B_2H_6$ or that of $PH_3$ and that of $H_2$ was changed to make drums having the value of ΔE of 0 eV (i-type) and 0.1 eV (p-type) and each having a dark resistivity of $5\times10^9$ Ωcm or more and make a photosensitive member having ΔE of 0.2 eV (n-type) and a dark resistivity which was smaller than $5\times10^9$ Ωcm.

The manufactured light receiving member for electrophotography was evaluated similarly to Example 6.

The results of Example 6 and Comparative Example 6 are shown in Table 12. It can be understood that when the conduction type of the photoconductive layer has the same polarity as that of the charging potential, ΔE is 0.01 to 0.3 eV and the dark resistivity is $5\times10^9$ Ωcm or more, the optical memory can be improved.

TABLE 12

| | Example 6 | | | Comparative Example 6 | | |
|---|---|---|---|---|---|---|
| ΔE (eV) | 0.05 | 0.1 | 0.25 | 0 | 0.1 | 0.2 |
| Conduction Type | n | n | n | i | p | n |
| Dark Resistance | $5 \times 10^{12}$ | $2 \times 10^{12}$ | $5 \times 10^{10}$ | $1 \times 10^{12}$ | $5 \times 10^{11}$ | $1 \times 10^{9}$ |
| Charging Performance | ○ | ○ | ○ | ◎ | ◎ | Δ |
| Residual Potential | ◎ | ◎ | ◎ | ○ | Δ | ◎ |
| Optical Memory (ghost) | ◎ | ◎ | ◎ | Δ | Δ | ◎ |
| Roughness | ◎ | ◎ | ◎ | Δ | Δ | ◎ |
| Total | ◎ | ◎ | ◎ | Δ | Δ | Δ |

Example 7

The apparatus for manufacturing the light receiving member for electrophotography shown in FIG. 6 was used so that a light receiving member for electrophotography for positive charge was formed on an aluminum cylinder having a mirror surface by the DC glow discharge method in accordance with the foregoing procedure. In this example, four types of charge injection inhibiting layers were formed respectively having a ΔE of 0.01 eV (p-type), ΔE of 0.08 eV (p-type), ΔE of 0.2 eV (p-type), and ΔE of 0.3 eV (p-type). Each sample had a density of state of $5\times10^{17}$ $cm^{-3}$. The control of DE and the density of state was performed by changing the flow of the $B_2H_6$ gas flow and the film forming speed. Each parameter was measured by manufacturing samples on a glass substrate and a light receiving member for electrophotography was manufactured under the same conditions.

In this example, a photoconductive layer having ΔE of 0.11 eV (p-type) and a dark resistivity of $1\times10^{12}$ Ωcm was used.

The manufactured light receiving member for electrophotography was set to a copying machine NP-9800 manufactured by Canon and arranged to be adaptable to the experiment so that the charging performance at the time of the positive charge, the residual potential, roughness and ghost were evaluated.

TABLE 13

| Layers | Gas and Flow (sccm) | DC Power (W) | Internal Pressure (Torr) | Temperature of Supporting member (° C.) | Thickness of Layer (μm) |
|---|---|---|---|---|---|
| Charge Injection Inhibiting Layer | SiH4 (change)<br>NO (change)<br>CH4 0<br>B2H6 (change)<br>H2 (change) | 500 | 0.5 | 290 | 3 |
| Photoconductive Layer | SiH4 500<br>B2H6 1.5 ppm<br>H2 350 | 500 | 0.5 | 290 | 15 |
| Surface Layer | SiH4 30<br>CH4 500 | 300 | 0.3 | 290 | 0.5 |

Comparative Example 7

A light receiving member for electrophotography for positive charge was manufactured similarly to Example 7 except the flow of the raw material gas at the time of forming the charge injection inhibiting layer. In this comparative example, charge injection inhibiting layers respectively having ΔE of 0 eV (i-type), ΔE of 0.32 eV (p-type) and ΔE of 0.15 eV (n-type) were manufactured. The density of state was made to be $5\times10^{17}$ $cm^{-3}$ similarly to Example 7.

The manufactured light receiving member for electrophotography was evaluated similarly to Example 7.

The results of Example 7 and Comparative Example 7 are shown in Table 14. The photosensitive member according to the present invention has improved roughness occurring at the time of forming a half tone image.

TABLE 14

| | Example 7 | | | | Comparative Example 7 | | |
|---|---|---|---|---|---|---|---|
| ΔE (eV) | 0.01 | 0.08 | 0.2 | 0.3 | 0 | 0.32 | 0.15 |
| Conduction Type | p | p | p | p | i | p | n |
| Charging Performance | ○ | ○ | ○ | ○ | ○ | ○ | Δ |
| Residual Potential | ◎ | ◎ | ◎ | ◎ | ◎ | ◎ | Δ |
| Optical Memory (ghost) | ◎ | ◎ | ◎ | ◎ | ◎ | ◎ | Δ |
| Roughness | ◎ | ◎ | ◎ | ◎ | Δ | Δ | Δ |
| Total | ◎ | ◎ | ◎ | ◎ | Δ | Δ | X |

Example 8

The apparatus for manufacturing the light receiving member for electrophotography shown in FIG. 6 was used similarly to Example 7 so that a light receiving member for electrophotography for negative charge was formed under manufacturing conditions shown in Table 15. In this example, four types of charge injection inhibiting layers were formed respectively having a ΔE of 0.01 eV (n-type), ΔE of 0.08 eV (n-type), ΔE of 0.2 eV (n-type), and ΔE of 0.3 eV (n-type). Each sample had a density of states of $5\times10^{17}$ $cm^{-3}$. The control of ΔE and the density of state was performed by changing $B_2H_6$ or the flow of the $B_2H_6$ gas and the film forming speed. Each parameter was measured by manufacturing samples on a glass substrate and a light receiving member for electrophotography was manufactured under the same conditions.

In this example, a photoconductive layer having ΔE of 0.11 eV (n-type) and a dark resistivity of $1\times10^{12}$ Ωcm was used.

The manufactured light receiving member for electrophotography was set to a copying machine NP-9800 manufactured by Canon and arranged to be adaptable to the experiment so that the charging performance at the time of the positive charge, the residual potential, roughness and ghost were evaluated.

TABLE 15

| Layers | Gas and Flow (sccm) | DC Power (W) | Internal Pressure (Torr) | Temperature of Supporting member (° C.) | Thickness of Layer (μm) |
|---|---|---|---|---|---|
| Charge Injection Inhibiting Layer | SiH4 (change)<br>NO (change) | 500 | 0.5 | 290 | 3 |

TABLE 15-continued

| Layers | Gas and Flow (sccm) | | DC Power (W) | Internal Pressure (Torr) | Temperature of Supporting member (° C.) | Thickness of Layer (μm) |
|---|---|---|---|---|---|---|
| | CH4 | 0 | | | | |
| | PH3 or B2H6 | (change) | | | | |
| | H2 | (change) | | | | |
| Photoconductive Layer | SiH4 | 500 | 500 | 0.5 | 290 | 15 |
| | B2H6 | 0 | | | | |
| | H2 | 350 | | | | |
| Surface Layer | SiH4 | 30 | 300 | 0.3 | 290 | 0.5 |
| | NO | 500 | | | | |
| | B2H6 | 300 | | | | |

Comparative Example 8

A light receiving member for electrophotography for negative charge was manufactured similarly to Example 8 except the flow of the raw material gas at the time of forming the charge injection inhibiting layer. In this comparative example, charge injection inhibiting layers respectively having ΔE of 0 eV (i-type), ΔE of 0.32 eV (n-type) and ΔE of 0.15 eV (p-type) were manufactured. The density of state was made to be $5\times10^{17}$ $cm^{-3}$ similarly to Example 8.

The manufactured light receiving member for electrophotography was evaluated similarly to Example 8.

The results of Example 8 and Comparative Example 8 are shown in Table 14. The Photosensitive member according to the present invention has improved roughness occurring at the time of forming a half tone image.

TABLE 16

| | Example 8 | | | | Comparative Example 8 | | |
|---|---|---|---|---|---|---|---|
| ΔE (eV) | 0.01 | 0.08 | 0.2 | 0.3 | 0 | 0.32 | 0.15 |
| Conduction Type | n | n | n | n | i | n | p |
| Charging Performance | ○ | ○ | ○ | ○ | ○ | ○ | Δ |
| Residual Potential | ◎ | ◎ | ◎ | ◎ | ◎ | ◎ | Δ |
| Optical Memory (ghost) | ◎ | ◎ | ◎ | ◎ | ◎ | ◎ | Δ |
| Roughness | ◎ | ◎ | ◎ | ◎ | Δ | Δ | Δ |
| Total | ◎ | ◎ | ◎ | ◎ | Δ | Δ | X |

Example 9

An apparatus for manufacturing a light receiving member for electrophotography shown in FIG. 3 was used to manufacture a light receiving member for electrophotography for positive charge shown in FIG. 3 on an aluminum cylinder having a mirror surface in accordance with the foregoing procedure by employing the DC glow discharge method under manufacturing conditions shown in Table 17. In this embodiment, the charge injection inhibiting layer has a DE of 0.08 eV (p-type) and the densities of states were made to be $1\times10^{17}$ $cm^{-3}$, $1\times10^{18}$ $cm^{-3}$ and $5\times10^{19}$ $cm^{-3}$. The the quantity of $B_2H_6$ and that of $H_2$ at the time of forming the photoconductive layer were changed to control ΔE and the density of states. Each parameter was measured by previously forming samples on a glass substrate and a photoconductive member for electrophotography was manufactured under the same conditions.

In this example, a photoconductive layer having ΔE of 0.11 eV (p-type) and a dark resistivity of $1\times10^{12}$ Ωcm was used.

The manufactured light receiving member for electrophotography was set to an electrophotographic apparatus obtained by modifying the copying machine NP-9800 manufactured by Canon to be adaptable to the experiments so that the charging performance at the time of positive charge, the residual potential, the optical memory (ghost) and the roughness were evaluated.

TABLE 17

| Layers | Gas and Flow (sccm) | | DC Power (W) | Internal Pressure (Torr) | Temperature of Supporting member (° C.) | Thickness of Layer (μm) |
|---|---|---|---|---|---|---|
| Charge Injection Inhibiting Layer | SiH4 | 500 | 500 | 0.5 | 290 | 3 |
| | NO | 10 | | | | |
| | CH4 | 0 | | | | |
| | B2H6 | (change) | | | | |
| | H2 | (change) | | | | |
| Photoconductive Layer | SiH4 | 500 | 500 | 0.5 | 290 | 15 |
| | B2H6 | 1.5 ppm | | | | |
| | H2 | 350 | | | | |
| Surface Layer | SiH4 | 30 | 300 | 0.3 | 290 | 0.5 |
| | CH4 | 500 | | | | |

Comparative Example 9

A light receiving member for electrophotography for positive charge was manufactured similarly to Example 9 except the flow of the raw material gas at the time of forming the charge injection inhibiting layer. In this comparative example, charge injection inhibiting layers respectively having ΔE of 0.08 eV (p-type) and densities of state of $1\times10^{16}$ $cm^{-3}$, $5\times10^{16}$ $cm^{-3}$ and $8\times10^{19}$ $cm^{-3}$ were manufactured.

The manufactured light receiving member for electrophotography was evaluated similarly to Example 9.

The results of Example 9 and Comparative Example 9 are shown in Table 18. The photosensitive member according to the present invention has improved roughness occurring at the time of forming a half tone image.

TABLE 18

| | Example 9 | | | Comparative Example 9 | | |
|---|---|---|---|---|---|---|
| ΔE (eV) | 0.08 | 0.08 | 0.08 | 0.08 | 0.08 | 0.08 |
| Local Level Density ($cm^{-3}$) | $1\times10^{17}$ | $1\times10^{18}$ | $5\times10^{19}$ | $1\times10^{16}$ | $5\times10^{16}$ | $8\times10^{19}$ |
| Conduction Type | p | p | p | p | p | p |

TABLE 18-continued

| | Example 9 | | | Comparative Example 9 | | |
|---|---|---|---|---|---|---|
| Charging Performance | ○ | ○ | ○ | x | Δ | Δ |
| Residual Potential | ◎ | ◎ | ◎ | ◎ | ◎ | Δ |
| Optical Memory (ghost) | ◎ | ◎ | ◎ | ◎ | ◎ | Δ |
| Roughness | ◎ | ◎ | ◎ | ◎ | ◎ | Δ |
| Total | ◎ | ◎ | ◎ | X | Δ | X |

Example 10

The apparatus for manufacturing the light receiving member for electrophotography shown in FIG. 6 was used so that a light receiving member for electrophotography for negative charge was manufactured under manufacturing conditions shown in Table 19. In this example, charge injection inhibiting layers having ΔE of 0.08 eV (n-type) and respectively having local level densities of state $1\times10^{17}$ $cm^{-3}$, $1\times10^{18}$ $cm^{-3}$ and $5\times10^{19}$ $cm^{-3}$ were manufactured. ΔE and density of states were controlled by adjusting the flow of the $B_2H_6$ gas and the $H_2$ gas at the time of forming the films. Each parameter was measured by previously forming samples on a glass substrate, and a light receiving member for electrophotography was manufactured under the same conditions.

In this example, a photoconductive layer having ΔE of 0.11 eV (n-type) and a dark resistivity of $1\times10^{12}$ Ωcm was used.

The manufactured light receiving member for electrophotography was set to a copying machine NP-9800 manufactured by Canon and arranged to be adaptable to the experiment so that the charging performance at the time of the negative charge, the residual potential, roughness and ghost were evaluated.

TABLE 19

| Layers | Gas and Flow (sccm) | | DC Power (W) | Internal Pressure (Torr) | Temperature of Supporting member (° C.) | Thickness of Layer (μm) |
|---|---|---|---|---|---|---|
| Charge Injection Inhibiting Layer | SiH4 | 500 | 500 | 0.5 | 290 | 3 |
| | NC | 10 | | | | |
| | CH4 | 0 | | | | |
| | PH3 or B2H6 | (change) | | | | |
| | H2 | (change) | | | | |
| Photoconductive Layer | SiH4 | 500 | 500 | 0.5 | 290 | 15 |
| | B2H6 | 0 | | | | |
| | H2 | 350 | | | | |
| Surface Layer | SiH4 | 30 | 300 | 0.3 | 290 | 0.5 |
| | NO | 500 | | | | |
| | B2H6 | 300 | | | | |

Comparative Example 10

A light receiving member for electrophotography for negative charge was manufactured similarly to Example 10 except the flow of the raw material gas at the time of forming the charge injection inhibiting layer. In this comparative example, charge injection inhibiting layers respectively having ΔE of 0.08 eV (p-type) and densities of state of $1\times10^{16}$ $cm^{-3}$, $5\times10^{16}$ $cm^{-3}$ and $8\times10^{19}$ $cm^{-3}$ were manufactured.

The manufactured light receiving member for electrophotography was evaluated similarly to Example 10.

The results of Example 10 and Comparative Example 10 are shown in Table 20. The photosensitive member according to the present invention has improved roughness occurring at the time of forming a half tone image.

TABLE 20

| | Example 10 | | | Comparative Example 10 | | |
|---|---|---|---|---|---|---|
| ΔE (eV) | 0.08 | 0.08 | 0.08 | 0.08 | 0.08 | 0.08 |
| Local Level Density ($cm^{-3}$) | $1 \times 10^{17}$ | $1 \times 10^{18}$ | $5 \times 10^{19}$ | $1 \times 10^{16}$ | $5 \times 10^{16}$ | $8 \times 10^{19}$ |
| Conduction Type | n | n | n | n | n | n |
| Charging Performance | ○ | ○ | ○ | X | Δ | Δ |
| Residual Potential | ◎ | ◎ | ◎ | ◎ | ◎ | Δ |
| Optical Memory (ghost) | ◎ | ◎ | ◎ | ◎ | ◎ | Δ |
| Roughness | ◎ | ◎ | ◎ | ◎ | ◎ | Δ |
| Total | ◎ | ◎ | ◎ | X | Δ | X |

Example 11

A similar experiment to that according to Example 9 was performed except for the density of state was controlled by adjusting the NO gas flow in place of adjusting the film forming speed. As a result, a clear image was formed similarly to Example 9.

Example 12

A similar experiment to that according to Example 10 was performed except for the density of states was controlled by adjusting the NO gas flow in place of adjusting the film forming speed. As a result, a clear image was formed similarly to Example 6.

Example 13

A similar experiment to that according to Example 9 was performed except that the density of states was controlled by adjusting the $CH_4$ gas flow in place of adjusting the film forming speed. As a result, a clear image was formed similarly to Example 5.

Example 14

A similar experiment to that according to Example 6 was performed except that the density of states was controlled by adjusting the $CH_4$ gas flow in place of adjusting the film forming speed. As a result, a clear image was formed similarly to Example 6.

Example 15

A light receiving member for electrophotography was manufactured similarly to Example 5 except that the surface layer of the light receiving member for electrophotography according to Example 5 was replaced by the surface layer according to Example 1.

As a result, the optical memory characteristics were improved and excellent durability was attained even in an environment in which the concentration of vapor of the organic solvent is higher than a usual level.

When the surface layers according to Example 1 to 4 were replaced by those according to Examples 5 to 14 while combining in different manners, light receiving members for electrophotography having excellent characteristics were obtained.

The light receiving member according to the present invention is not limited to the foregoing descriptions, and therefore modifications and combinations within the thesis of the present invention are permitted.

Example 16

An example of the interface evaluation system by means of the SIMS will now be described. However, the present invention is not limited to examples to be described hereinafter.

SIMS samples were manufactured in each of which an a-Si:H layer and an a-SiC:H layer were stacked on a silicon wafer ground to have a mirror surface. The a-Si type semiconductor layer was deposited by the rf plasma CVD method. The a-Si:H layer was formed under conditions that the $SiH_4$ gas was 100 sccm, pressure was 0.5 Torr, the RF power was 50 W and the temperature of the substrate was 250° C. The a-SiC:H layer was formed under conditions that the $SiH_4$ gas was 10 sccm, the $CH_4$ gas was 600 sccm, the pressure was 0.5 Torr, the RF power was 100 W and the temperature of the substrate was 250° C. The thickness of the a-Si:H layer and that of the a-SiC:H layer were intended to be values shown in Table 21 (sample Nos. 16-1 to 16-4).

TABLE 21

| | Thickness of Layer | |
|---|---|---|
| Sample No. | a-Si:H | a-SiC:H |
| 16-1 | 0.1 μm | 0.01 μm |
| 16-2 | 0.1 μm | 0.03 μm |
| 16-3 | 0.1 μm | 0.08 μm |
| 16-4 | 0.1 μm | 0.14 μm |

Silicon atoms and carbon atoms of the foregoing samples were SIMS analyzed. The SIMS analysis was performed under conditions shown in Table 22.

TABLE 22

| | |
|---|---|
| Primary Ion Source | $Cs^+$ |
| Secondary Ion Source | Positive |
| Primary Ion Energy (keV) | 2.0 |
| Primary Ion Current (nA) | 86 |
| Raster Area (μm square) | 400 |
| Area Analyzed (μmφ) | 60 |

*measuring apparatus: CAMECA IMS-3F

Figure 9:
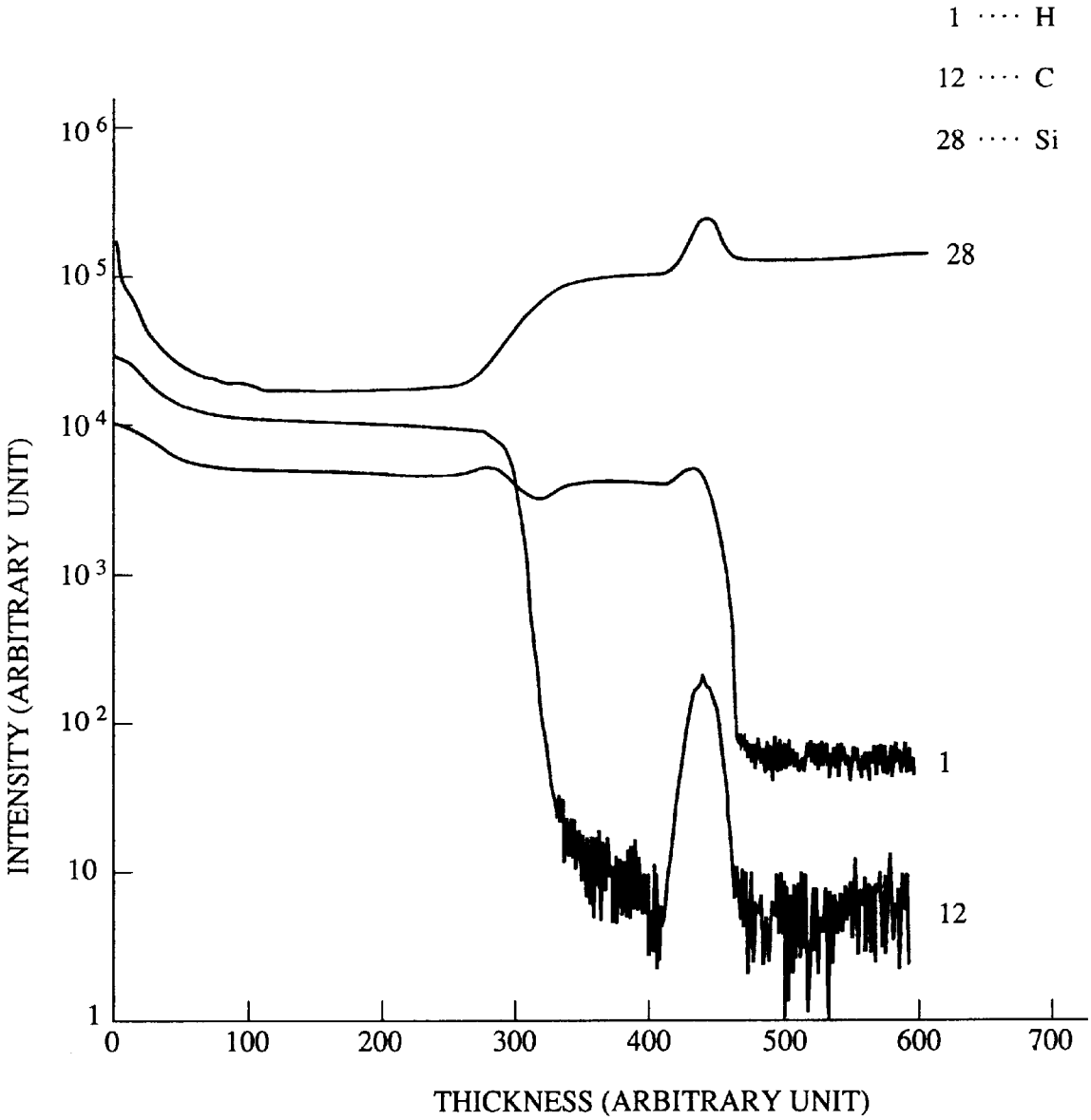
FIG. 9 is a schematic view which illustrates data obtained from SIMS analysis.

The SIMS was measured by using IMF-SF manufactured by CAMECA. The SIMS was controlled by using computer 360 manufactured by HP. An example of the SIMS measurement is shown in FIG. 9. As shown in FIG. 9, the carbon concentration was rapidly lowered in the vicinity of the interface between the a-SiC: H and a-Si:H layers.

Figure 7:
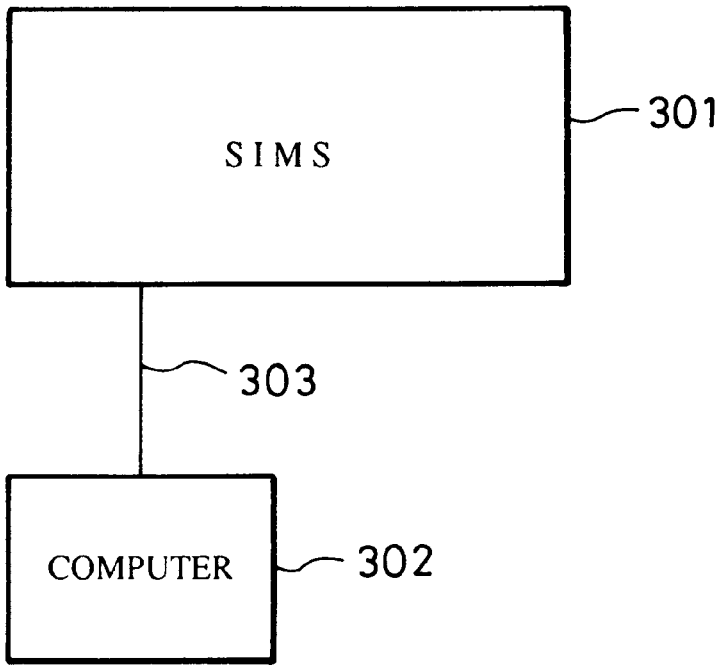
FIG. 7 is a schematic view which illustrates a SIMS analyzing apparatus having an evaluation system according to the present invention.
Figure 8:
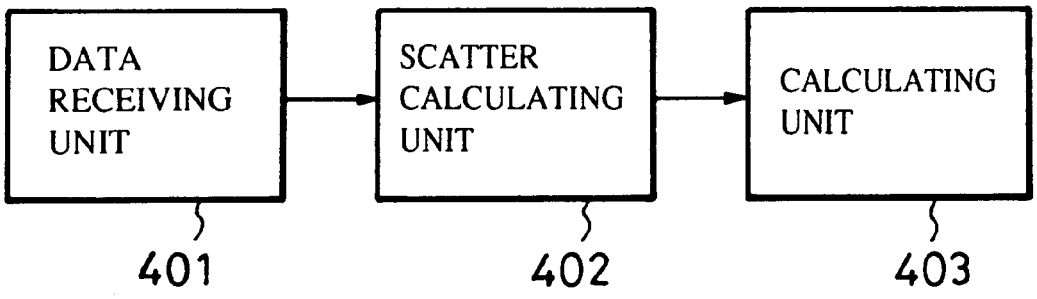
FIG. 8 is a schematic view which illustrates the evaluation system according to the present invention.

As shown in FIG. 7, obtained data was received by the computer (the control and analyzing apparatus) 302 from the SIMS 301 through the control cable 303 so that data was supplied to the evaluation system according to the present invention shown in FIG. 8. That is, obtained data was received by a data receiving unit 401, and the scatter calculating unit 402 calculated the scatter of carbon atoms occurring at the interface. The results of the calculations were displayed by a calculating unit 403 for displaying the relationship between the thickness of the a-SiC:H layer and the scatter.

The relationship between the thickness and the scatter and that between the thickness and the standard deviation obtained by the evaluation system according to the present invention are shown in Table 23.

TABLE 23

| Sample No. | Thickness of a-SiC:H layer measured by SIMS (depth at which concentration of C is lowered to the half) A | Steepness of interface between a-SiH and a-SiC:H Scatter (Å) | Standard Deviation (Å) |
|---|---|---|---|
| 16-1 | 67 | 324 | 18 |
| 16-2 | 330 | 1156 | 34 |
| 16-3 | 740 | 3721 | 62 |
| 16-4 | 1390 | 6561 | 81 |

Figure 10:
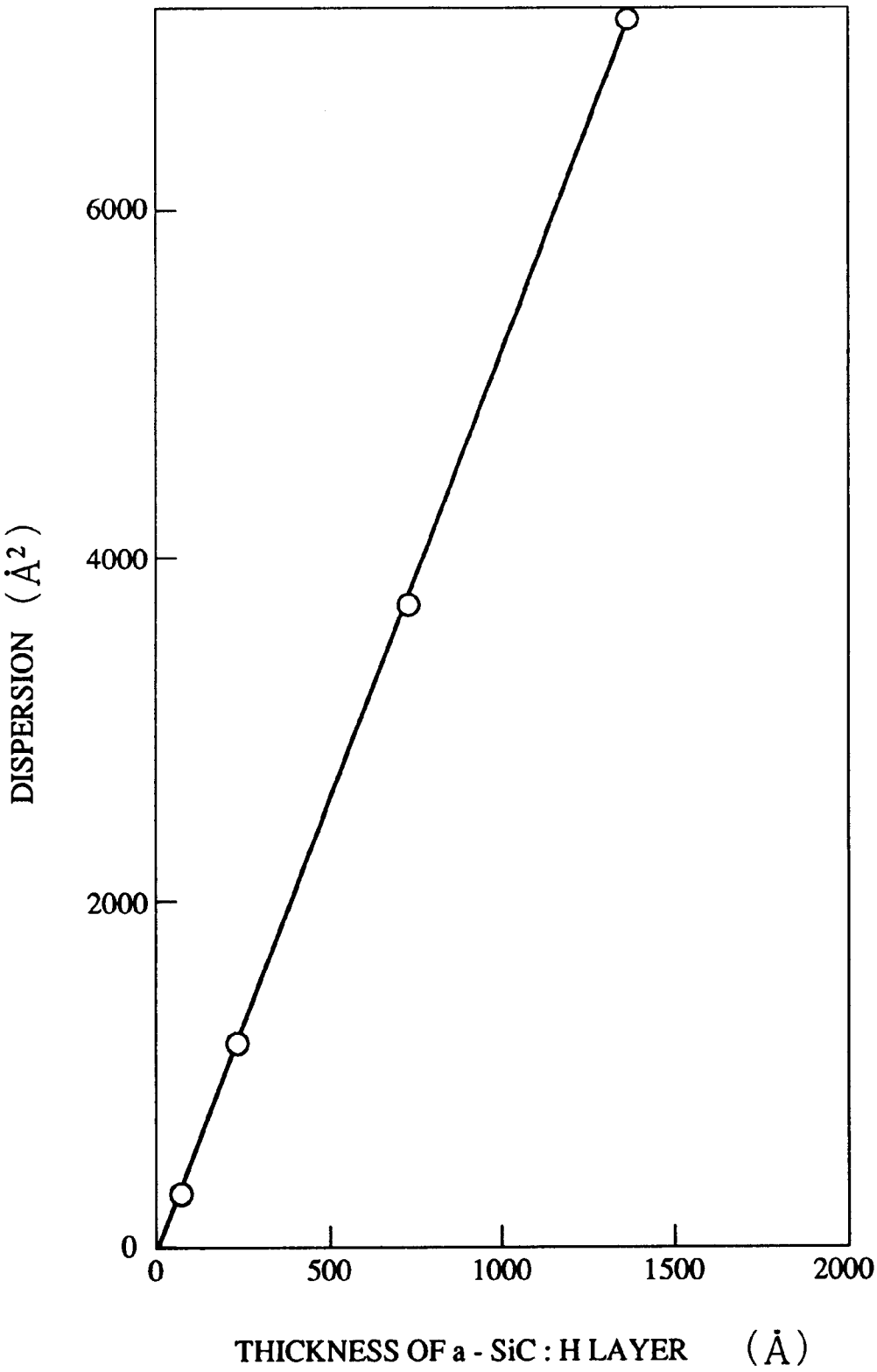
FIG. 10 illustrates the results of analysis obtained by an analysis system according to the present invention.
Figure 11:
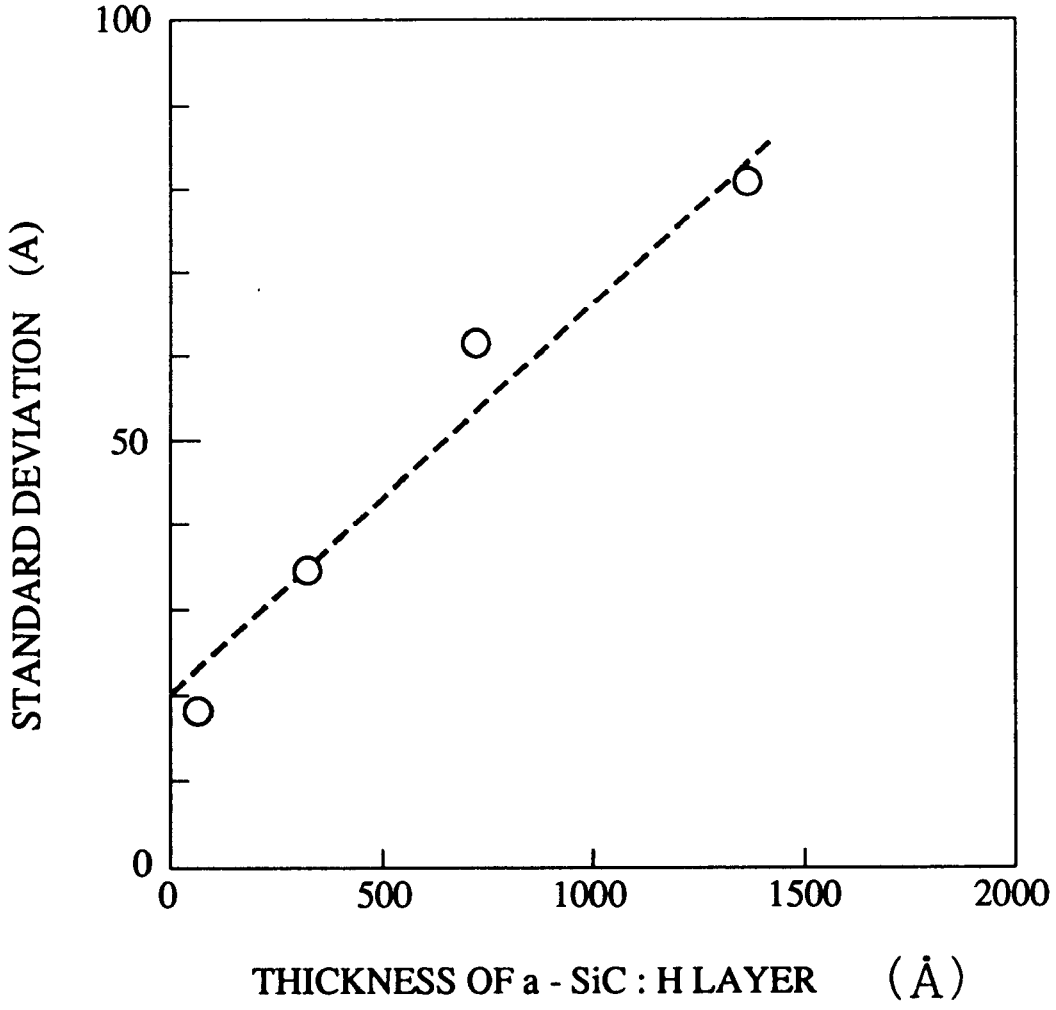
FIG. 11 illustrates an example of display of the results of analysis performed by a conventional evaluation system.

The relationship between the thickness and scatter obtained by the evaluation system according to the present invention is shown in FIG. 10. The conventional relationship between the thickness and the standard deviation is shown in FIG. 11. It was found that the evaluation system according to the present invention exhibited a clearer straight relationship. Further, the evaluation system according to the present invention was superior to the conventional evaluation system in evaluating the steepness of the interface.

As described above, the light receiving member for electrophotography having the surface layer according to the present invention is able to significantly improve the durability in adverse environments while maintaining excellent electric, optical, photoconductive characteristics.

The photosensitive member for electrophotography according to the present invention arranged such that the charge injection inhibiting layer and the photoconductive layer respectively have proper conductivities and the density of states of the charge injection inhibiting layer is made to be within a specific range is able to overcome various problems experienced with the conventional photosensitive member for electrophotography made of a-Si when it is adapted to a recent electrophotographic apparatus that must meet the desires for high speed operation and excellent image quality. In particular, excellent electrical, optical, photoconductive and image characteristics can be exhibited.

According to the present invention, the arrangement is such that the conduction type of the photoconductive layer is a reduced polarity conduction type having the same polarity as the charging polarity will improve the residual potential and the optical memory while maintaining the charging performance. By making the conduction type of the charge injection inhibiting layer to be the same polarity and similar intensity to those of the photoconductive layer, generation of the depletion layer between the photoconductive layer and the charge injection inhibiting layer can be prevented. Further, the arrangement made in such a manner that the density of states in the charge injection inhibiting layer is adequately controlled is able to effectively inhibit the injection of carriers from the supporting member. As a result of the foregoing structures, image roughness occurring in a half tone image when a high speed process is performed can be prevented.

Further, the SIMS interface evaluation system according to the present invention for measuring the steepness of the interfaces of the stacked films by the secondary ion mass spectrometry (SIMS) and having the unit for calculating the scatter, which is the reference of the interface steepness, from the difference of the SIMS values of the subject element in the direction of the thickness and the calculating unit for displaying the scatter with respect to the subject parameter of the SIMS is able to further accurately evaluate the interface steepness of a multi-layer film as compared with the conventional evaluation system.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A light receiving member for electrophotography comprising:

a supporting member having an electrically conductive surface and a light receiving layer on said supporting member;

said light receiving layer comprising, in order of layers closest to the supporting member at least a photoconductive layer and a surface layer thereon, said photoconductive layer comprising a non-single-crystal material containing silicon atoms as a matrix, and said surface layer comprising an amorphous material containing, at least, silicon atoms and carbon atoms;

the carbon atoms of said surface layer including, at least diamond-bonded carbon atoms and graphite-bonded carbon atoms, the ratio of the number of said graphite-bonded carbon atoms to the total number of carbon atoms being from 4.9% to 24.7% and the carbon atoms present in amounts from 45 to 90 atomic % based on the total of the silicon atoms and the carbon atoms.

2. A light receiving member for electrophotography according to claim 1, wherein a charge injection inhibiting layer is present between said photoconductive layer and said supporting member.

3. A light receiving member for electrophotography according to claim 1, wherein said photoconductive layer comprises a charge generating layer and a charge transporting layer.

4. A light receiving member for electrophotography according to claim 1, wherein said surface layer is from 0.01 to 10 $\mu$m in thickness.

5. A light receiving member for electrophotography according to claim 1, wherein said light receiving layer is from 1 to 100 $\mu$m in thickness.

6. A light receiving member for electrophotography according to claim 1 wherein a contact layer is present between said supporting member and said photoconductive layer, said contact layer being an amorphous material containing (a) at least one of hydrogen atoms and halogen atoms, (b) at least one of nitrogen atoms and oxygen atoms and (c) silicon atoms.

7. A light receiving member for electrophotography according to claim 1, wherein said surface layer further contains at least one of hydrogen atoms and halogen atoms.

8. A light receiving member for electrophotography according to claim 7, wherein said halogen atoms are fluorine atoms.

9. A light receiving member for electrophotography comprising:

a supporting member having an electrically conductive surface; and a light receiving layer on said supporting member, wherein said light receiving layer comprising at least, in order of layers closest to said supporting layer, a charge injection inhibiting layer from 0.1 to 5 $\mu$m in thickness and a photoconductive layer from 1 to 70 $\mu$m in thickness;

said photoconductive layer comprised of a non-single-crystal material comprising silicon atoms as a matrix, hydrogen atoms and an element for controlling conduction type;

said charge injection inhibiting layer containing silicon atoms as a matrix, hydrogen atoms, at least one element selected from the group consisting of oxygen, nitrogen and carbon, and an element for controlling the conductive type;

wherein, when said light receiving member has positive charging polarity, said photoconductive layer and said charge injection inhibiting layer have the same polarity and said charge injection inhibiting layer exhibits p conduction type of the same level as or less than that of said photoconductive layer, whereas, when said light receiving member has negative charging polarity, said photoconductive layer and said charge injection inhibiting layer have the same polarity and said charge injection inhibiting layer exhibits n conduction type of the same level as or less than that of said photoconductive layer;

wherein said charge injection inhibiting layer has a density of states from $1\times10^{17}$ cm$^{-3}$ to $5\times10^{19}$ cm$^{-3}$; and, wherein a difference $\Delta E$ between half of optical band gap and activation energy is from 0.01 eV to 0.3 eV for said photoconductive layer and said charge injection inhibiting layer.

10. A light receiving member for electrophotography according to claim 9, wherein a second charge injection inhibiting layer for inhibiting injection of carriers is formed on said photoconductive layer.

11. A light receiving member for electrophotography according to claim 10, wherein said second charge injection inhibiting layer is a surface layer.

12. A light receiving member for electrophotography according to claim 11, wherein said surface layer is from 0.01 to 10 $\mu$m in thickness.

13. A light receiving member for electrophotography according to claim 11, wherein said surface layer contains material selected from the group consisting of a non-single-crystal material, an inorganic insulating compound and an organic insulating compound.

14. A light receiving member for electrophotography according to claim 9, wherein when both said photoconductive layer and said charge injection inhibiting layer are of p-type, said element for controlling the conduction type is an element of Group III of the Periodic Table.

15. A light receiving member for electrophotography according to claim 14, wherein said Group III element is at least one element selected from the group consisting of boron, aluminum, gallium, indium and thallium.

16. A light receiving member for electrophotography according to claim 14, wherein said element present in amounts $1\times10^{-3}$ to $5\times10^{4}$ atomic ppm.

17. A light receiving member for electrophotography according to claim 9, wherein when both said photoconductive layer and said charge injection inhibiting layer are of n-type, said element for controlling the conduction type is an element of Group V of the Periodic Table.

18. A light receiving member for electrophotography according to claim 17, wherein said Group V element is at least one element selected from the group consisting of phosphorus, arsenic, antimony and bismuth.

19. A light receiving member for electrophotography according to claim 17, wherein said element is present in amounts from $1\times10^{-3}$ to $5\times10^{4}$ atomic ppm.

* * * * *

UNITED STATES PATENT AND TRADEMARK OFFICE

CERTIFICATE OF CORRECTION

PATENT NO. : 6,365,308 B1
DATED : April 2, 2002
INVENTOR(S) : Satoshi Kojima et al.

It is certified that error appears in the above-identified patent and that said Letters Patent is hereby corrected as shown below:

Column 3,
Line 24, “images” should read -- image --; and “image” should read -- images --.

Column 4,
Line 63, “a” should read -- an --.

Column 5,
Line 60, “members,” should read -- member, --.

Column 10,
Line 57, “is” should read -- are --.

Column 13,
Line 51, “camber.” should read -- chamber. --.

Column 16,
Table 1, “SiH4 should read -- $SiH_4$
C2H4 $C_2H_4$
Si(C2H5)4 $Si(C_2H_5)_4$
CH4 $CH_4$
He He
B2H6/SiH4” $B_2H_6/SiH_4$ --.

Column 17,
Table 1, “H2” should read -- $H_2$ --

Column 18,
Table 5, “SiH4 should read -- $SiH_4$
C2H4 $C_2H_4$
Si(C2H5)4 $Si(C_2H_5)_4$
CH4 $CH_4$
He He
B2H6/SiH4 $B_2H_6/SiH_4$
H2” $H_2$ --.

UNITED STATES PATENT AND TRADEMARK OFFICE

CERTIFICATE OF CORRECTION

PATENT NO. : 6,365,308 B1
DATED : April 2, 2002
INVENTOR(S) : Satoshi Kojima et al.

It is certified that error appears in the above-identified patent and that said Letters Patent is hereby corrected as shown below:

Column 19,

Table 6, "SiH4 should read -- $SiH_4$

| | |
|---|---|
| C2H4 | $C_2H_4$ |
| Si(C2H5)4 | $Si(C_2H_5)_4$ |
| CH4 | $CH_4$ |
| He | He |
| B2H6/SiH4 | $B_2H_6/SiH_4$ |
| H2 | $H_2$ --; and |

"306 W should read -- 300 W --.

Column 20,

Table 7, "SiH4 should read -- $SiH_4$

| | |
|---|---|
| C2H4 | $C_2H_4$ |
| Si(C2H5)4 | $Si(C_2H_5)_4$ |
| CH4 | $CH_4$ |
| He | $B_2H_6/SiH_4/SiH_4$ |
| H2" | $H_2$ --. |

Column 22,

Table 9, "SiH4 should read -- $SiH_4$

| | |
|---|---|
| NO | NO |
| CH4 | $CH_4$ |
| B2H6 | $B_2H_6$ |
| H2 | $H_2$ |
| SiH4 | $SiH_4$ |
| B2H6 | $B_2H_6$ |
| H2 | $H_2$ |
| SiH4 | $SiH_4$ |
| CH4" | $CH_4$ --. |

Column 25,

Table 13, "SiH4 should read -- $SiH_4$

| | |
|---|---|
| NO | NO |
| CH4 | $CH_4$ |
| B2H6 | $B_2H_6$ |
| H2 | $H_2$ |
| SiH4 | $SiH_4$ |
| B2H6 | $B_2H_6$ |
| H2 | $H_2$ |
| SiH4 | $SiH_4$ |
| CH4" | $CH_4$ --. |

UNITED STATES PATENT AND TRADEMARK OFFICE

CERTIFICATE OF CORRECTION

PATENT NO. : 6,365,308 B1
DATED : April 2, 2002
INVENTOR(S) : Satoshi Kojima et al.

It is certified that error appears in the above-identified patent and that said Letters Patent is hereby corrected as shown below:

Column 26,
Table 15, "SiH4" should read -- $SiH_4$ --.

Column 27,
Table 15, "CH4 should read -- $C_2H_4$

| | |
|---|---|
| PH3 or | $PH_3$ |
| B2H6 | $B_2H_6$ |
| H2 | $H_2$ |
| SiH4 | $SiH_4$ |
| B2H6 | $B_2H_6$ |
| H2 | $H_2$ |
| SiH4 | $SiH_4$ |
| NO | NO |
| B2H6" | $B_2H_6$ --. |

Column 28,
Table 17, "SiH4 should read -- $SiH_4$

| | |
|---|---|
| NO | NO |
| CH4 | $CH_4$ |
| B2H6 | $B_2H_6$ |
| H2 | $H_2$ |
| SiH4 | $SiH_4$ |
| B2H6 | $B_2H_6$ |
| H2 | $H_2$ |
| SiH4 | $SiH_4$ |
| CH4" | $CH_4$ --. |

Column 30,
Table 19, "SiH4 should read -- $SiH_4$

| | |
|---|---|
| NC | NC |
| CH4 | $CH_4$ |
| PH3 or | $PH_3$ or |
| B2H6 | $B_2H_6$ |
| H2 | $H_2$ |
| SiH4 | $SiH_4$ |
| B2H6 | $B_2H_6$ |
| H2 | $H_2$ |
| SiH4 | $SiH_4$ |
| NO | NO |
| B2H6" | $B_2H_6$ --. |

UNITED STATES PATENT AND TRADEMARK OFFICE

CERTIFICATE OF CORRECTION

PATENT NO. : 6,365,308 B1
DATED : April 2, 2002
INVENTOR(S) : Satoshi Kojima et al.

It is certified that error appears in the above-identified patent and that said Letters Patent is hereby corrected as shown below:

Column 32,
Table 22, after “Primary Ion Current (nA)”, “86” should read -- 80 --.

Signed and Sealed this

Twenty-ninth Day of October, 2002

*Attest:*

*Attesting Officer*

JAMES E. ROGAN
*Director of the United States Patent and Trademark Office*